US007735949B2

(12) United States Patent
Takahashi et al.

(10) Patent No.: US 7,735,949 B2
(45) Date of Patent: Jun. 15, 2010

(54) PRINTING POSITION ADJUSTING METHOD AND PRINTING SYSTEM

(75) Inventors: Kiichiro Takahashi, Yokohama (JP); Minoru Teshigawara, Yokohama (JP); Tetsuya Edamura, Kawasaki (JP); Akiko Maru, Tokyo (JP); Yoshiaki Murayama, Tokyo (JP); Takatoshi Nakano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 12/021,602

(22) Filed: Jan. 29, 2008

(65) Prior Publication Data

US 2008/0211854 A1 Sep. 4, 2008

(30) Foreign Application Priority Data

Feb. 2, 2007 (JP) ..... 2007-024731

(51) Int. Cl.
*B41J 29/38* (2006.01)

(52) U.S. Cl. ..... 347/14; 347/19

(58) Field of Classification Search ..... 347/14, 347/15, 19, 41, 43, 116, 16
See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 6,700,593 | B2 * | 3/2004 | Otsuki | 346/19 |
| 2005/0052494 | A1 | 3/2005 | Takahashi et al. | |
| 2006/0038842 | A1 | 2/2006 | Chikuma | |
| 2009/0231376 | A1 * | 9/2009 | Moriya | 347/14 |

FOREIGN PATENT DOCUMENTS

| | | |
|---|---|---|
| EP | 516366 A | 12/1992 |
| EP | 1681168 A | 7/2006 |
| JP | 54-56847 | 5/1979 |
| JP | 59-123670 | 7/1984 |
| JP | 59-138461 | 8/1984 |
| JP | 60-71260 | 4/1985 |
| JP | 11-291470 | 10/1999 |

* cited by examiner

*Primary Examiner*—Thinh H Nguyen
(74) *Attorney, Agent, or Firm*—Fitzpatrick, Cella, Harper & Scinto

(57) ABSTRACT

The present invention relates to a printing position adjusting method capable of performing dot adjustment value acquisition processing that can accommodate diversified user needs of recent years, and a printing system capable of achieving the adjusting method. The printing position adjusting method according to the present invention provides a plurality of types of dot adjustment value acquisition processing capable of acquiring an adjustment value for matching printing positions, and enables selection of a single appropriate dot adjustment value acquisition processing type among the plurality of types of dot adjustment value acquisition processing according to the type of the print medium to be used. Consequently, a user will be able to suitably execute dot adjustment value acquisition processing with high accuracy in correspondence with the desired high level of quality.

10 Claims, 14 Drawing Sheets

PRINTING POSITION ADJUSTING METHOD AND PRINTING SYSTEM

BACKGROUND OF THE INVENTION

1. Field of the Invention

The present invention relates to a printing position adjusting method for dots printed on a print medium and to a corresponding printing system, host apparatus and program.

2. Description of the Related Art

In recent years, relatively inexpensive office equipment including personal computers, word processors and the like have proliferated. Consequently, various printing apparatuses that print information inputted via such equipment as well as techniques that enable the apparatuses to operate at high speed or with high quality are being developed at a rapid pace. Among such printing apparatuses, a serial printer using a dot matrix printing method has been attracting attention as a printing apparatus (printer) capable of realizing high speed or high quality printing at low cost.

In the case of a printing apparatus that performs, for example, bidirectional printing to achieve high speed, misalignment of positions of dots formed in a forward scan and positions of dots formed in a backward scan on a print medium causes ruled line misalignment and therefore a degradation in print quality. That is, when vertical ruled lines perpendicular to the scan direction of the print head are alternately formed in forward scans and backward scans, the positions of dots printed in the forward scans may fail to align with those printed in the backward scans, causing the ruled lines to lose their straightness. This line misalignment is one of the most common forms of print quality degradation perceived by users. Since ruled lines are often printed in black, line misalignment tends to be perceived as a problem encountered in black images. However, similar phenomena occur with images in which ruled lines are formed in other colors.

Such a misalignment between the positions of dots printed during forward scans and backward scans may have an adverse effect on an image, causing a phenomenon called "texture" when multi-pass printing is performed in order to enhance print quality. Multi-pass printing refers to a print method in which image data corresponding to a predetermined area on a print medium is divided among a plurality of print scans using a mask pattern, whereby the predetermined area is completed by a plurality of print scans. When using multi-pass printing, although phenomena such as the aforementioned ruled line misalignment are unlikely to be perceived even when misalignments occur between the positions of dots printed during forward scans and backward scans, there are cases where an unpleasant pattern (texture) is perceived in an image. Such a texture appears in periods dependent on the applied mask pattern, and tends to become particularly noticeable in half tone areas of a printed image having a high density and a high contrast, such as when printing is performed in monochrome or on coated paper.

Further, in the case of a printing apparatus having a plurality of print heads such as four print heads that respectively print the four colors of yellow, magenta, cyan and black, if a misalignment occurs among the printing positions of the four print heads, a phenomenon called "color misalignment" occurs on the image.

The "color misalignment" phenomenon will now be described briefly. A blue color (for example) is formed when a dot of magenta ink and a dot of cyan ink are printed at a predetermined position on a print medium. In this case, a slight color difference will occur between an area where dots of the two colors overlap and an area where such overlapping does not occur. In a uniform blue image, if an area with such a slightly different color exists, the area will not stand out in the image provided that the area is small. However, when a misalignment occurs between positions (printing positions) of dots where magenta and cyan are printed in a specific print scan, there will be a recognizable difference between the blue color in the area printed in that scan and the blue colors in other areas. This will result in a band-like non-uniform blue image. In the present specification, such a phenomenon shall be referred to as "color misalignment". "Color misalignments" tend to be inconspicuous on plain paper, but become more noticeable on print mediums with higher color saturation such as coated paper.

When printing is performed at adjacent pixels by different print heads, if a misalignment occurs among the printing positions of dots printed by the respective print heads, gaps will form between the dots, thereby allowing the color of the print medium to be directly perceived. Since print mediums are mostly white, this phenomenon is referred to as an "unprinted portion". This phenomenon is particularly noticeable with images having strong contrasts. For example, when a black image is formed and a white area exists in the image where dots are not printed, "unprinted portions" are more easily recognized due to the strong contrast between white and black.

For the purpose of suppressing such print quality degradation as described above, many printing apparatuses on the market adopt dot adjustment value acquisition processing. Dot adjustment value acquisition processing (also referred to as printing position adjustment) according to the present specification refers to a series of processes for adjusting the relative positional relationship between the printing position of a dot printed in a first printing operation and the printing position of a dot printed in a second printing operation. The dot adjustment value acquisition processing includes a process for acquiring an adjustment value for adjusting printing positions. In this case, the first printing operation and the second printing operation respectively refer to, for example, printing by a forward scan and a backward scan in bidirectional printing. In addition, the adjustment value acquired in dot adjustment value acquisition processing is, for example, a correction value for adjusting timings at which a print head discharges ink during forward and backward scans in order to adjust the relative positional relationship between the printing position of a dot printed in a forward scan and the printing position of a dot printed in a backward scan during bidirectional printing.

A general procedure for performing dot adjustment value acquisition processing will be described below using bidirectional printing as an example. First, the printing apparatus prints a test pattern for acquiring an adjustment value. When printing a test pattern, firstly, in a forward scan, the printing apparatus prints a plurality of straight lines (reference lines) oriented perpendicular to the scan direction at constant intervals. Next, without conveying the print medium, a backward scan is performed by the print head to print the same number of straight lines (shift lines) in correspondence to the straight lines printed in the forward scan. In the backward scan, a plurality of straight lines are printed while varying ink discharge timings so as to shift the relative positional relationships with the straight lines printed in the forward scan. In this manner, a test pattern is completed, in which a plurality of ruled line patterns (adjustment patterns) constituted by straight lines printed during a forward scan and those printed during a backward scan is produced.

A user then visually judges and selects a ruled line pattern that is either straight or is closest to a straight line among the plurality of outputted ruled line patterns. Subsequently, a parameter used when the selected ruled line pattern was formed is inputted either directly into the printing apparatus via key operations or the like or by operating a host apparatus connected to the printing apparatus. Based on the inputted parameter, the printing apparatus sets optimum discharge timings for adjusting printing positions of dots printed in a forward scan and in a backward scan. Thereafter, printing operations of the respective scans are performed according to the set discharge timings.

In the case where dot adjustment value acquisition processing is performed among a plurality of print heads, dot adjustment value acquisition processing can be performed in the same manner as in the example of bidirectional printing described above by, for example, having the plurality of print heads respectively print pluralities of straight lines oriented perpendicular to the scan direction.

The method heretofore described is a method in which a test pattern is printed to be visually judged by a user (hereinafter referred to as manual dot adjustment value acquisition processing). However, not only is this method troublesome for the user, there are also risks that judgmental and operational errors may occur. Accordingly, in recent years, a method of automatically performing dot adjustment value acquisition processing (hereinafter referred to as automatic dot adjustment value acquisition processing) through the use of an optical sensor has been proposed and put to practical use (for example, refer to Japanese Patent Laid-open No. 11-291470).

Specific processes carried out in the automatic dot adjustment value acquisition processing described in Japanese Patent Laid-open No. 11-291470 will now be briefly described using the case of bidirectional printing as an example. Similarly, with automatic dot adjustment value acquisition processing, a test pattern constituted by a plurality of adjustment patterns is first printed. When printing the test pattern, firstly, dots (reference dots) to be used as reference by the respective adjustment patterns are printed by a forward scan of the print head. Next, in a backward scan, for a plurality of adjustment patterns, dots (shift dots) are printed by shifting relative positions with respect to the reference dots by predetermined increments, thus completing the respective adjustment patterns.

The plurality of adjustment patterns is configured such that the mutual misalignment among the dots printed in the forward scan and dots printed in the backward scan result in a variance in the area factor of each adjustment pattern (in each adjustment pattern, the percentage of an area occupied by a dot with respect to the non-printed portion). The printing apparatus measures the respective average densities of the plurality of adjustment patterns using an optical sensor, whereby the pattern with the highest average density is judged to be the pattern having minimal printing position misalignment. Based on the adjustment pattern, the printing apparatus automatically sets an optimum discharge timing for adjusting printing positions with respect to each print scan by each print head. Such an automatic dot adjustment value acquisition processing eliminates the need for performing troublesome operations on the part of the user, and obviates the risks of judgmental and operational errors.

Nevertheless, if the configuration of a printing apparatus only allows printing position adjustment through automatic dot adjustment value acquisition processing, the occurrence of a situation during automatic dot adjustment value acquisition processing where normal operations cease due to an unforeseen cause makes printing position adjustment of dots impossible at that point. In this light, Japanese Patent Laid-open No. 11-291470 also discloses a configuration that accommodates both the automatic dot adjustment value acquisition processing and the manual dot adjustment value acquisition processing and, at the same time, prompts the user to perform the manual dot adjustment value acquisition processing only in the event that an error occurs during automatic dot adjustment value acquisition processing.

Furthermore, providing both manual dot adjustment value acquisition processing and automatic dot adjustment value acquisition processing enables dot adjustment value acquisition processing to be provided such that diversified needs of users ranging from those familiar with using printing apparatuses to novices can be accommodated.

With manual dot adjustment value acquisition processing, a user is required to perform operations for: having a printing apparatus print test patterns; observing the test patterns and selecting an optimum condition; and inputting the condition into the printing apparatus or the host apparatus. As seen, manual dot adjustment value acquisition processing requires that the user perform many troublesome procedures. Such tasks are particularly confusing and cumbersome to novice users who are not used to handling printing apparatuses. However, manual dot adjustment value acquisition processing wherein adjustment of printing positions is performed by visually confirming adjustment patterns through the user's own eyes enables users more experienced with the handling of printing apparatuses to perform adjustment in a satisfactory manner. Therefore, there may be cases where adjustment is performed with higher accuracy than automatic dot adjustment value acquisition processing.

On the other hand, automatic dot adjustment value acquisition processing wherein everything from printing test patterns to acquiring adjustment values is performed automatically is advantageous in that troublesome operations such as inputting on the part of the user are no longer necessary.

In other words, manual dot adjustment value acquisition processing is able to accommodate demands towards high accuracy printing position adjustment from experienced users. In addition, automatic dot adjustment value acquisition processing is able to accommodate demands towards adjusting printing positions without having to perform troublesome operations from novice users unfamiliar with the handling of printing apparatuses. Therefore, providing both manual dot adjustment value acquisition processing and automatic dot adjustment value acquisition processing enables dot adjustment value acquisition processing to be provided such that demands from both users familiar with using printing apparatuses and novice users can be accommodated.

However, in conventional dot adjustment value acquisition processing, inexpensive plain paper is generally used as a print medium. In other words, printing position adjustment is performed using plain paper for both processing that requires high accuracy printing position adjustment (e.g., manual dot adjustment value acquisition processing) and processing that does not require high accuracy adjustment (e.g., automatic dot adjustment value acquisition processing).

Plain paper is a print medium that is inexpensive and relatively easy to obtain. Accordingly, the use of plain paper in printing position adjustment processing sufficiently accommodates the needs of novice users who prefer performing simplified adjustment over high accuracy adjustment.

However, plain paper is a print medium wherein landed ink is likely to bleed among the paper fibers, and has a disadvantage in that variations in the relative positional relationships among reference dots and shift dots in test patterns are poorly reflected on density characteristics or the like. In other words, when printing test patterns using plain paper, it is necessary to vary the relative shift amounts between the reference dots and the shift dots somewhat coarsely to ensure that a predetermined density variation is obtained among adjustment patterns. Therefore, in such a case, since the variation of relative shift amounts of the test patterns is somewhat coarse, an adjustment value having a high adjustment accuracy cannot be acquired, thereby making high accuracy printing position adjustment impossible. As a result, cases will occur where high quality images desired by a user may not be obtained when printing images on high quality print paper such as coated paper on which the influences of dot misalignment are more likely manifested. As shown, there may be cases where the use of plain paper in printing position adjustment makes it impossible to accommodate the needs of users who desire high accuracy printing position adjustment.

SUMMARY OF THE INVENTION

The present invention is directed to a printing position adjusting method capable of accommodating dot adjustment value acquisition processing with high accuracy and a printing system capable of achieving the adjusting method.

It is desirable to provide a dot adjustment value acquisition processing corresponding to user needs and to enable high accuracy dot adjustment value acquisition processing.

According to a first aspect of the present invention, there is provided a method of adjusting the relative position of a first dot and a second dot being printed on a print medium, comprising:

selecting either a lower accuracy position adjustment mode for use with a first print medium, or a higher accuracy position adjustment mode for use with a further print medium, acquiring an adjustment value using the selected position adjustment mode, and adjusting the relative position of the second dot relative to the first dot using the acquired adjustment value.

According to a second aspect of the present invention, there is provided a host apparatus connectable to a printing apparatus capable of acquiring an adjustment value for adjusting a relative positional relationship on a print medium of a first dot and a second dot among a plurality of dots printed on the print medium, the host apparatus comprising:

a selection unit that causes selection of either one of a first dot adjustment value acquisition mode in which the printing apparatus acquires, using a first print medium, a first adjustment value for adjusting the positional relationship and a second dot adjustment value acquisition mode in which the printing apparatus acquires, using a second print medium, a second adjustment value that enables adjustment of the positional relationship at a higher adjustment accuracy than the first adjustment value; and a transmission unit that transmits information on the selected dot adjustment value acquisition mode to the printing apparatus.

According to a third aspect of the present invention, there is provided a printing system capable of adjusting the relative position of a first dot and a second dot being printed on a print medium, comprising:

a selecting unit configured to select, or to allow a user to select, either a lower accuracy position adjustment mode for use with a first print medium, or a higher accuracy position adjustment mode for use with a further print medium, an acquisition unit configured to acquire an adjustment value using the selected position adjustment mode, a printing unit capable of printing dots, and an adjustment unit adapted to adjust the relative position of a second dot relative to a first dot using the acquired adjustment value.

According to a fourth aspect of the present invention, there is provided a computer readable storage medium storing a program which when loaded into a computer and executed performs the following method of adjusting the relative position of a first dot and a second dot being printed on a print medium:

selecting either a lower accuracy position adjustment mode for use with a first print medium, or a higher accuracy position adjustment mode for use with a further print medium, acquiring an adjustment value using the selected position adjustment mode, and adjusting the relative position of the second dot relative to the first dot using the acquired adjustment value.

The present invention is particularly advantageous since dot adjustment value acquisition processing corresponding to user needs can be provided. In addition, the present invention enables high accuracy dot adjustment value acquisition processing and achieves high quality image printing.

Further features of the present invention will become apparent from the following description of exemplary embodiments with reference to the attached drawings.

DESCRIPTION OF THE EMBODIMENTS

Embodiments of the present invention will now be described in detail with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, or other substrates capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

(Configuration of Printing Apparatus)

Figure 1:
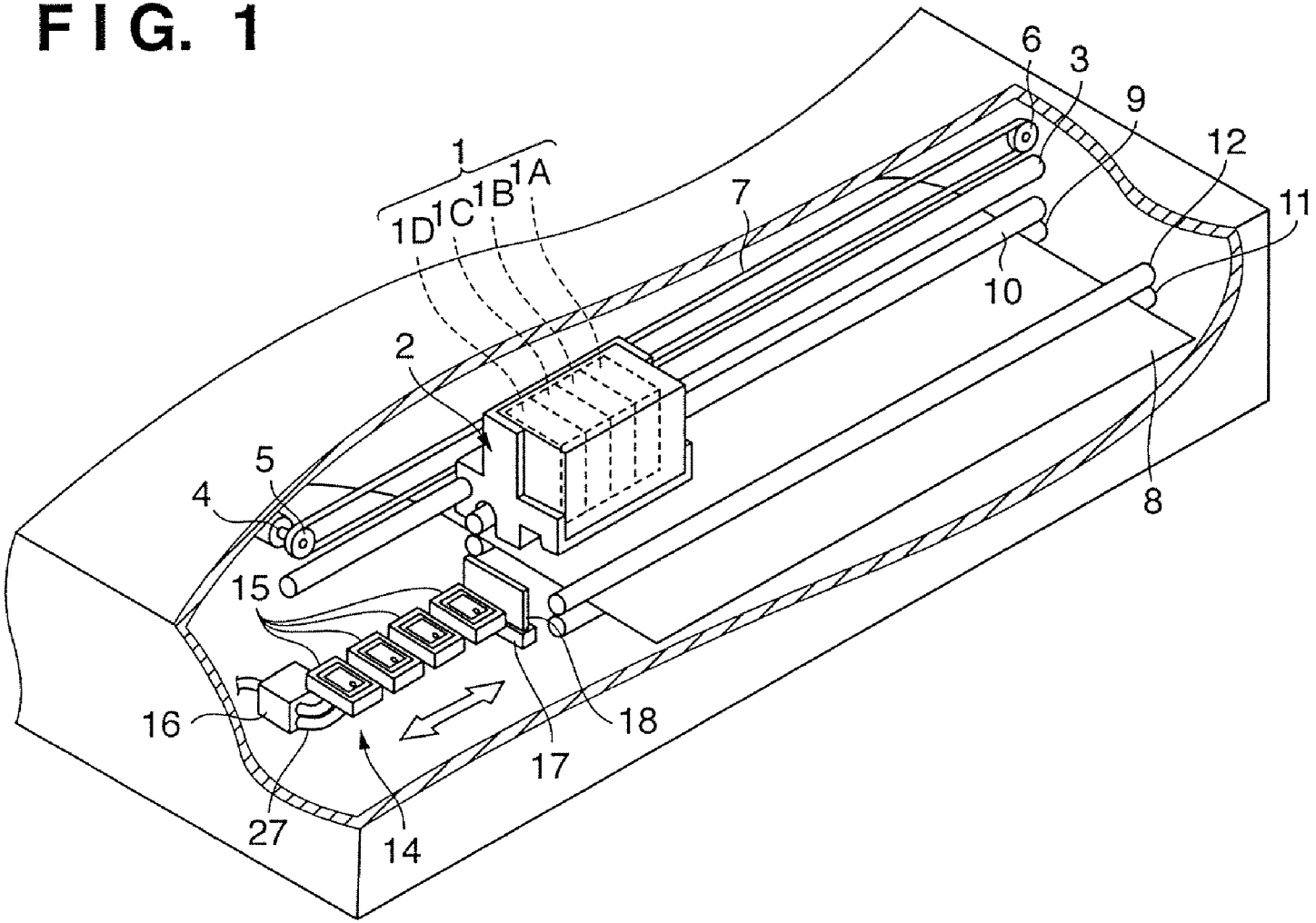
FIG. 1 is a perspective view schematically showing a configuration of components of an ink jet printing apparatus to which the present invention is applicable.

FIG. 1 is a perspective view schematically showing a configuration of components of an ink jet printing apparatus to which the present invention is applicable. In FIG. 1, reference characters 1A, 1B, 1C and 1D denote head cartridges that are respectively independently mounted on a carriage 2 so as to be exchangeable. Each of the head cartridges 1A to 1D is provided with a connector for receiving a signal that drives a print head. In the following description, the head cartridges 1A to 1D in their entirety or any one of the head cartridges shall simply be referred to as head cartridge (print head) 1.

Each of the plurality of head cartridges discharges ink of different colors. For example, cyan (C), magenta (M), yellow (Y) and black (Bk) inks are contained in an ink tank unit provided in the head cartridge 1. Each of the head cartridges is positioned and mounted on the carriage 2 so as to be exchangeable. The carriage 2 is provided with a connector holder (electric connection unit) for supplying a drive signal or the like to each of the head cartridges via a connector.

The carriage 2 is guided and supported so as to be reciprocally movable in a main scan direction along a guide shaft 3 installed in the printing apparatus main body. A main scan motor 4 drives the carriage 2 via a motor pulley 5, a driven pulley 6 and a timing belt 7 so as to control position and movement thereof.

A print medium 8 such as a sheet of paper or a thin plastic sheet is conveyed by the rotation of two pairs of conveyor rollers 9, 10 and 11, 12 so as to pass through a position (printing position) facing an orifice face of the head cartridge 1. A reverse surface of the print medium 8 is supported by a platen (not shown) so that a flat print surface can be formed thereon at the printing position. The two pairs of conveyor rollers (9 and 10, 11 and 12) also function to support the print medium 8 on both sides of the printing position so that a predetermined distance is maintained between the orifice face of each of the head cartridges 1 mounted on the carriage 2 and the print medium 8 on the platen.

Although not shown in FIG. 1, an optical sensor is attached to the carriage 2. The optical sensor in the present embodiment is either a red LED or an infrared LED having a light emitting element and a light receiving element. These elements are attached at angles so as to be almost parallel to the print medium 8. The distance from the optical sensor to the print medium 8 is determined depending on the characteristic of the optical sensor used. In the present embodiment, this distance is set at around 6 to 8 mm. The optical sensor is preferably covered by a cylindrical member in order to minimize effects of mist and the like caused by ink discharge from the head cartridge 1.

The head cartridge 1 of the present embodiment is an ink jet print head having a plurality of print elements which generate thermal energy and discharge ink.

Figure 2:
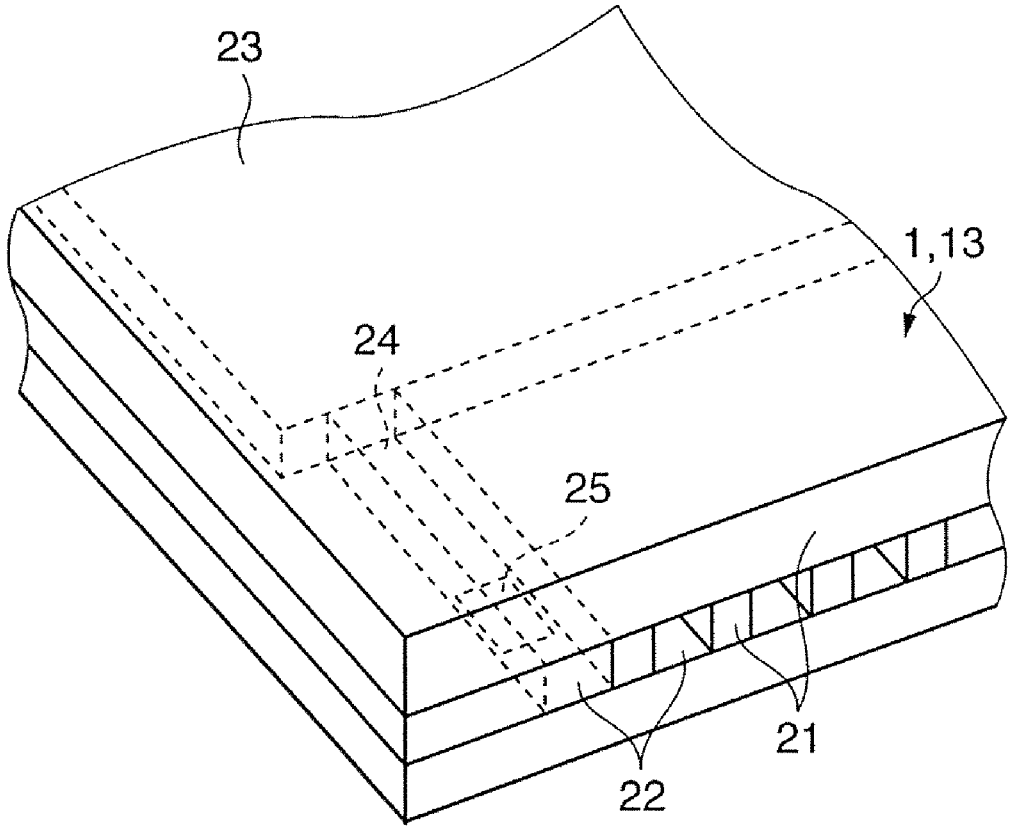
FIG. 2 is a schematic perspective view for describing the structure of an ink discharge unit.

FIG. 2 is a schematic perspective view for describing the structure of an ink discharge unit 13 of the head cartridge 1. In FIG. 2, an orifice face 21 is a face opposing the print medium 8 with a predetermined gap (in the present embodiment, about 0.5 to 2 mm) therebetween. A plurality of orifices 22 are formed at predetermined intervals on the orifice face 21. Each of the orifices 22 communicates via a plurality of flow channels 24 with a common liquid chamber 23. The portions between the common liquid chamber 23 and the orifices 22 are filled with ink. A discharge heater 25 that generates energy for discharging ink is placed on a wall surface of each flow channel 24.

When performing discharge, a predetermined voltage is applied to each discharge heater 25 based on an image signal or a discharge signal. Consequently, the discharge heater 25 transforms electric energy into thermal energy, whereby the generated heat causes boiling of the ink inside the flow channel 24. The pressure generated by rapidly forming bubbles pushes ink towards the orifice 22 and, as a result, a predetermined amount of ink is discharged in the form of a droplet. In the present embodiment, an ink jet print head is provided which utilizes pressure changes caused by the formation and contraction of bubbles due to such boiling to discharge ink from the orifice 22.

For the present embodiment, the head cartridge 1 is mounted on the carriage 2 so as to form a positional relationship in which the plurality of orifices 22 are aligned so that a line linking the centers of the orifices is perpendicular to the scan direction of the carriage 2.

(Configuration of Control Circuit)

Figure 3:
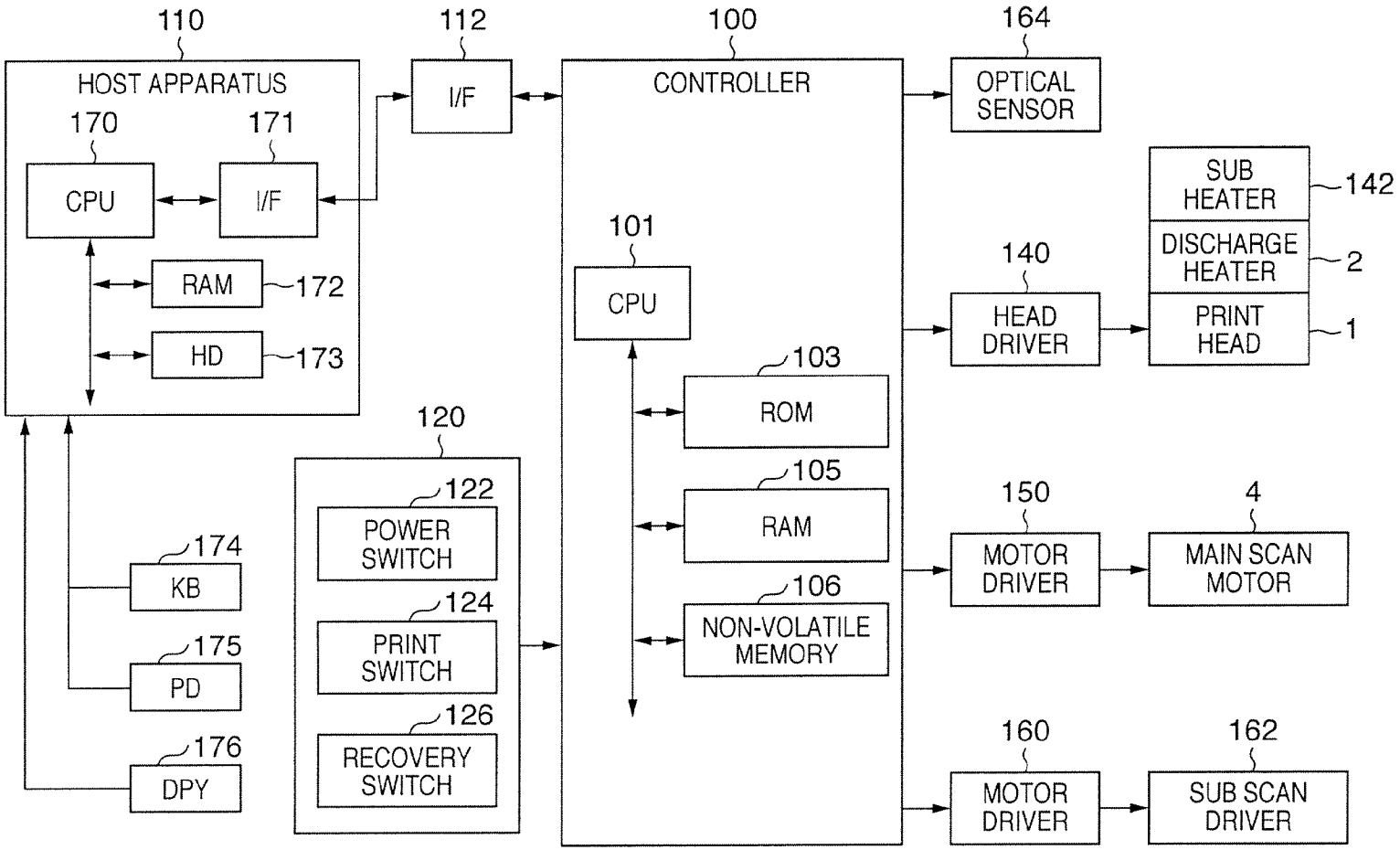
FIG. 3 is a block diagram for describing a configuration of control in an ink jet printing apparatus in an embodiment of the present invention.

FIG. 3 is a block diagram for describing a configuration of control in an ink jet printing apparatus applied in the present embodiment. In FIG. 3, a controller 100 constitutes a main control unit that performs overall printing control of the printing apparatus including drive control of the print head 1. The controller 100 is provided with, for example, a CPU 101 that takes the form of a microcomputer. The controller 100 is also provided with: a ROM 103 storing a program, necessary tables, and other fixed data; a RAM 105 having an area for decompressing image data, a work area, or the like; and a non-volatile memory 106 such as an EEPROM.

A host apparatus 110 is a source of image data for the printing apparatus and may be a computer that generates and processes print data or may take the form of an image reader or the like. The host apparatus 110 is provided with a CPU 170, an interface (I/F) 171, a RAM 172, and a hard disk (HD). A keyboard (KB) 174 and a pointing device (PD) 175 that are instructing means and a display (DPY) 176 that is a displaying means are connected to the host apparatus 110. Image data and other commands outputted from the host apparatus 110 are received by the controller 100 via the I/F 171 of the host apparatus and an interface (I/F) 112. Status signals and the like from the printing apparatus are also transmitted via the I/F 112 and the I/F 171 to the host apparatus 110.

An operating unit 120 is a group of switches that accepts input of instructions by the user, and includes: a power switch 122; a print switch 124 for instructing printing commencement; a recovery switch 126 for instructing activation of suction recovery, and the like.

A head driver 140 is a driver that drives the discharge heater 25 of the print head 1 according to print data and the like. The head driver 140 includes: a shift register that arranges print data in correspondence to the positions of the discharge heater 25; a latch circuit that latches the data at an appropriate timing; and a logic circuit element that activates the discharge heater 25 in synchronization with a drive timing signal. The head driver 140 also includes a timing setting unit that suitably sets a drive timing (discharge timing) so as to match dot forming positions, and the like.

A sub heater 142 is provided at the print head 1. The sub heater is arranged to perform temperature adjustment to stabilize ink discharge characteristics, and may either be built into a substrate of the print head 1 in correspondence to the discharge heater 25 or attached to the ink discharge unit 13 or a portion of the head cartridge 1.

A motor driver 150 is a driver that drives a main scan motor 4 for scanning a main scan direction that is the travel direction of the carriage 2. A motor driver 160 is a driver that drives a sub scan motor 162 for conveying the print medium 8 in a sub scan direction that is perpendicular to the main scan direction.

Reference numeral 164 denotes an optical sensor that is used when performing automatic dot adjustment value acquisition processing according to the present embodiment.

While the control diagram presented in FIG. 3 shows the keyboard (KB) 174 and the pointing device (PD) 175 that are instructing means and the display (DPY) 176 as being connected to the host, a configuration is also possible wherein these devices are provided in the printing apparatus.

First Embodiment

Dot adjustment value acquisition processing that characterizes the present invention will now be described. A printing apparatus provided in the present embodiment performs printing by so-called bidirectional printing and is capable of performing printing through both forward and backward scans of a print head. The printing apparatus is also able to execute dot adjustment value acquisition processing for adjusting the positional relationships between printing positions of dots printed in a forward scan and printing positions of dots printed in a backward scan. The print heads provided in the present embodiment have a plurality of orifice arrays for discharging ink of the same color, and are capable of performing dot adjustment value acquisition processing for adjusting the printing positions of dots printed by each orifice array. Furthermore, the printing apparatus is capable of performing dot adjustment value acquisition processing for adjusting printing positions of dots respectively printed by a plurality of print heads that discharges inks of different colors. As described, the printing apparatus according to the present embodiment is capable of performing printing position adjustment of dots printed by different printing operations (for example, forward and backward scans).

In addition, an ink jet printing apparatus according to the present embodiment is arranged so that two dot adjustment value acquisition processing modes, namely, a "normal dot adjustment value acquisition processing mode" and a "high accuracy dot adjustment value acquisition processing mode" are executable.

The ink jet printing apparatus is configured so that the plurality of types of dot adjustment value acquisition processing as described above can be performed in either mode.

(Normal Dot Adjustment Value Acquisition Processing)

A description of the "normal dot adjustment value acquisition processing mode" according to the present embodiment will now be given.

A feature of the "normal dot adjustment value acquisition processing mode" according to the present embodiment is that printing position adjustment is performed using plain paper. This is because the "normal dot adjustment value acquisition processing mode" is a mode intended to provide dot adjustment processing that is easy to use even for novices and is not a mode designed for executing high accuracy printing position adjustment. Therefore, inexpensive plain paper will be used in this mode wherein dot adjustment value acquisition processing which does not require a high adjustment accuracy is performed.

This mode can be arranged so that printing position adjustment is performed through both "automatic dot adjustment value acquisition processing" and "manual dot adjustment value acquisition processing". However, it is preferable that a user can execute and complete dot adjustment value acquisition processing in an easy manner through adjustment performed by "automatic dot adjustment value acquisition processing" wherein dot printing position adjustment is automatically performed using an optical sensor.

Figure 4:
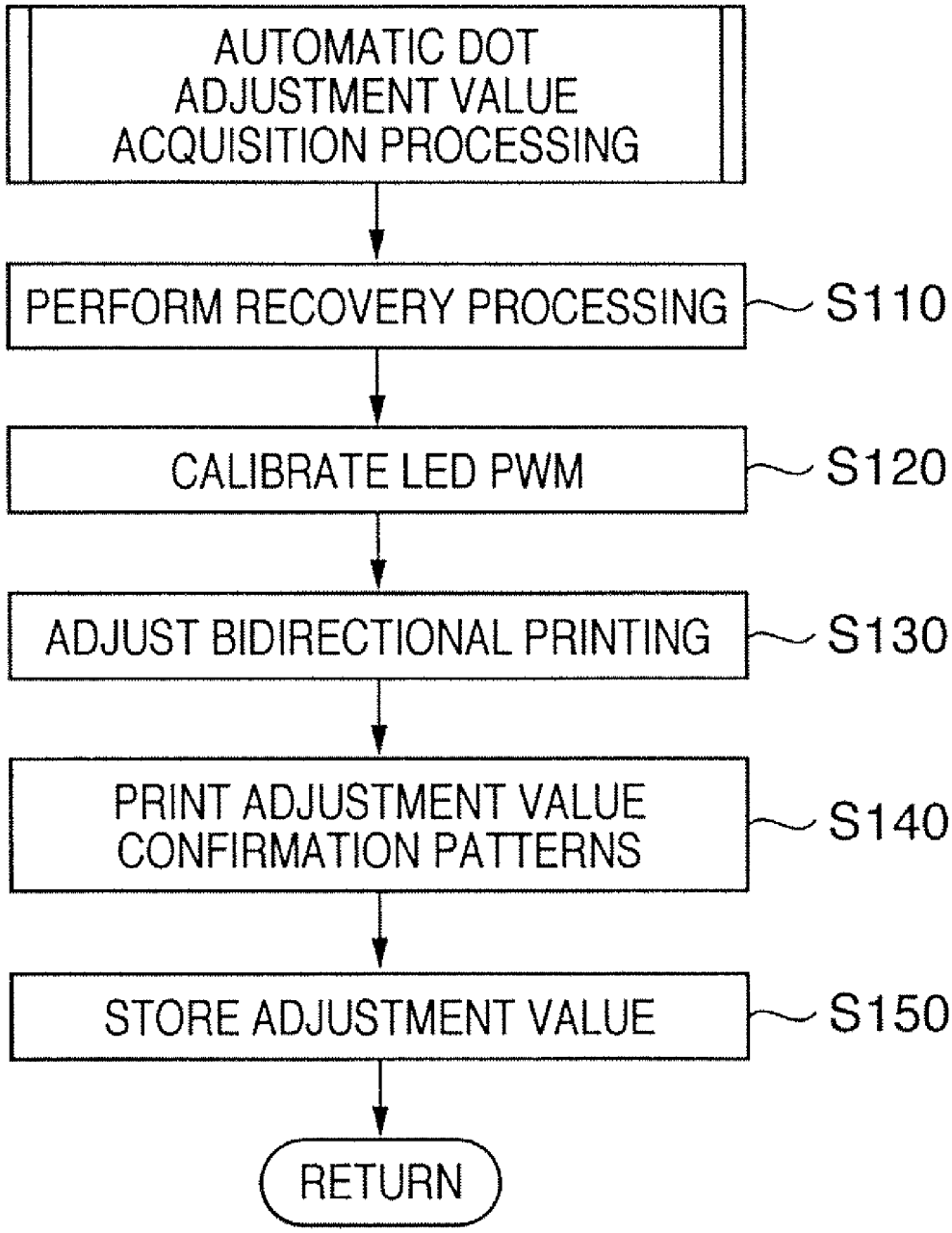
FIG. 4 is a flowchart showing a flow of a series of processes performed by a CPU in automatic dot adjustment value acquisition processing applied in an embodiment of the present invention.

FIG. 4 is a flowchart showing a flow of a series of process steps when printing position adjustment is executed by "automatic dot adjustment value acquisition processing" in which dot printing positions are automatically adjusted in the normal dot adjustment value acquisition processing mode according to the present embodiment. Below, a description will be given using, as an example, a case where dot adjustment value acquisition processing is executed in order to adjust the positional relationships between printing positions of dots printed in a forward scan and printing positions of dots printed in a backward scan.

When an automatic dot adjustment value acquisition processing sequence is commenced, recovery processing of the print head is first performed in step S110.

The recovery processing performed in step S110 involves performing a series of operations of suction, wiping and preliminary discharge on a print head immediately preceding the execution of automatic dot adjustment value acquisition processing. Consequently, since adjustment patterns can now be printed in a stable discharge state of the print head, dot adjustment value acquisition processing with higher reliability can be achieved.

While recovery processing has been described as a series of operations involving suction, wiping and preliminary discharge, the recovery processing performed in step S110 need not be limited to this arrangement. For example, recovery processing may be limited to only preliminary discharge or preliminary discharge and wiping in order to minimize the amount of waste ink produced in the present mode. However, in this case, the number of preliminary discharges is preferably set higher than during normal printing.

An alternative configuration is also possible in which execution or non-execution of a suction operation during the recovery processing performed in step S110 is determined according to the amount of time lapsed from the previous suction operation. In this case, judgment is first performed on whether a predetermined amount of time has lapsed from the previous suction operation. If the lapsed amount of time is shorter than the predetermined amount of time, processing proceeds as-is to step S120. On the other hand, if the lapsed amount of time is equal to or longer than the predetermined amount of time, the series of recovery processing including a suction operation is performed, whereby the sequence need only proceed to step S120 after the conclusion thereof.

Another alternative configuration is also possible wherein, the number of discharges performed by the print head is counted after the execution of the previous suction operation, and execution or non-execution of a suction operation in the recovery processing performed in step S110 is determined according to the counted value. In this case, while the recovery processing in step S110 may be arranged to be executed only when the number of discharges performed exceeds a predetermined value, a configuration is also possible in which the execution or non-execution of recovery processing is judged based on both a lapsed amount of time from a previous suction operation and a number of discharges performed.

As shown, by imposing various conditions, excessive suction operations can be prevented. Consequently, automatic dot adjustment value acquisition processing can be performed without wasting ink.

Furthermore, according to the present embodiment, the number of operations of suction, wiping and preliminary discharges performed or the order in which the operations are performed is not limited to any particular arrangement, and may be appropriately set according to use conditions.

In the subsequent step S120, calibration of an optical sensor (LED) is performed. In this case, the amount of current to be fed is adjusted so that the optical sensor can be used in a state in which output characteristics thereof attain linearity with respect to the density of an image to be read. More specifically, for example, the amount of current to be fed is controlled in stages in 5%-increments from a full energization of 100% duty down to an energization of 5% duty, whereby a plurality of patterns having different densities is read to obtain a current duty that is optimal for input values with respect to density variations to attain linearity. In subsequent steps, the optical sensor is driven by the current value hereby obtained. It is preferable that calibration is also performed on the receiving-side element of the optical sensor.

Next, in step S130, an acquisition value for adjusting the printing positions of dots printed in a forward scan and dots printed in a backward scan in bidirectional printing is acquired.

Figure 5:
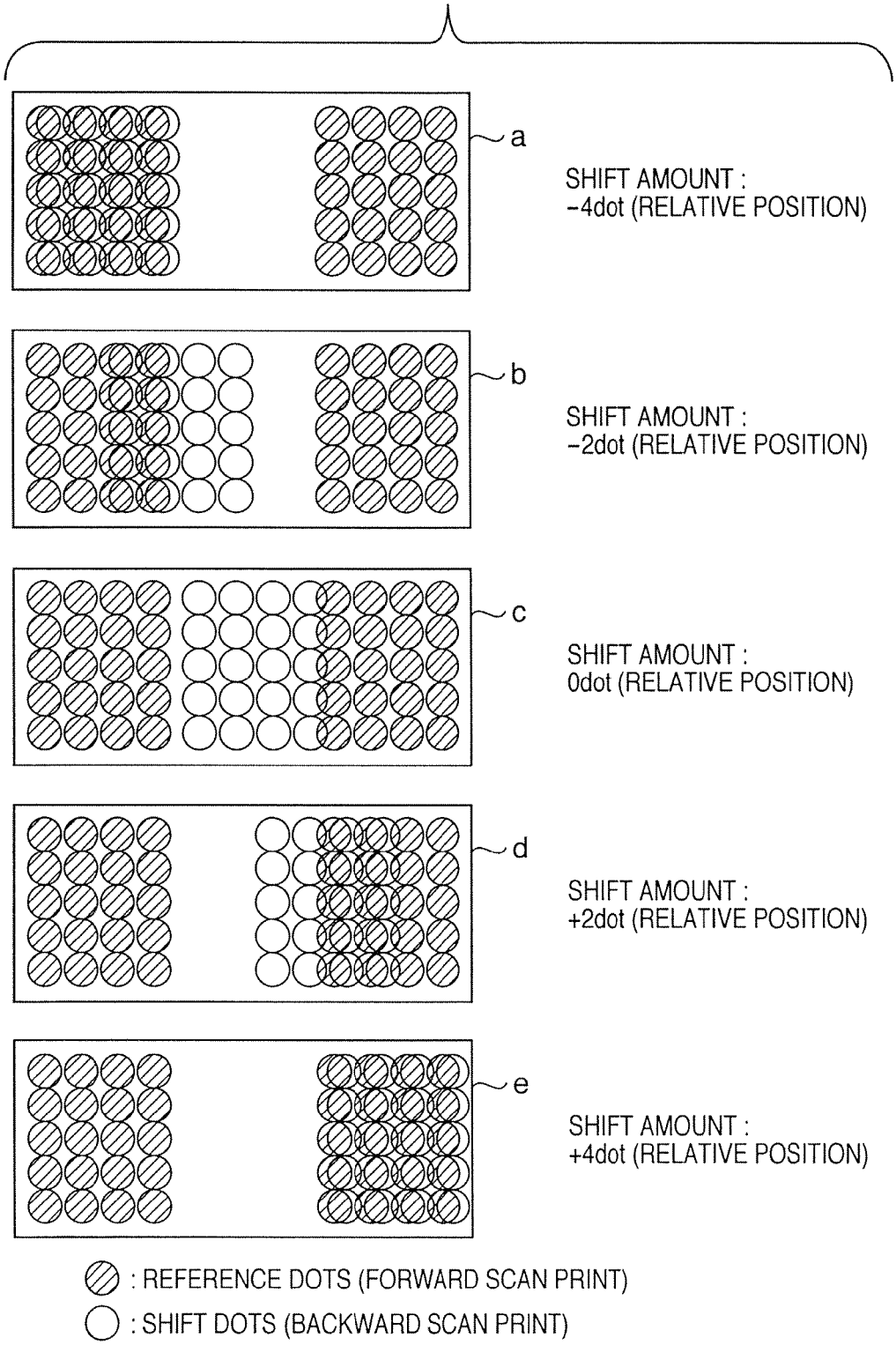
FIG. 5 is a diagram showing examples of test patterns for automatic dot adjustment value acquisition processing.

FIG. 5 is a diagram showing examples of test patterns for adjustment which are printed by the print head in order to acquire an adjustment value that adjusts the printing positions of forward and backward scans. In FIG. 5, hatched dots are assumed to be reference dots printed in a forward scan, and white dots are assumed to be shift dots printed in a backward scan. The test patterns shown in FIG. 5 are constituted by a plurality of adjustment patterns among which shift amounts of shift dots are varied with respect to reference dots. With the printing apparatus according to the present embodiment, the tolerance grade of the relative printing positions of forward and backward scans in bidirectional printing is ±4 dots. Accordingly, as shown in FIGS. 5*a* to 5*e*, a plurality of adjustment patterns is printed in variations of five stages by shifting the printing positions of the shift dots in 2 dot-increments with respect to the printing positions of the reference dots.

With the test patterns shown in FIG. 5, an ideal printing state is a state where the hatched dots that are reference dots and the white dots that are shift dots do not overlap each other and the shift dots are printed between the reference dots. In this case, an ideal printing state is a state where no misalignments exist between the printing positions of the dots printed in a forward scan and the dots printed in a backward scan. Therefore, from a design perspective, a pattern printed when the shift amount is set to zero should be a pattern representing an ideal printing state. However, in actual practice, due to the existence of mechanical errors such as manufacturing variations of the print head, the ideal printing state is not attained even when the shift amount is zero (the case of FIG. 5*c*). Consequently, the shift amount where an ideal printing state is attained or, in other words, an adjustment value that adjusts printing positions of forward and backward scans is acquired through the following procedure.

First, the optical density of each printed adjustment pattern (FIGS. 5*a* to 5*e*) is measured using an optical sensor mounted on the carriage 2.

Figure 6:
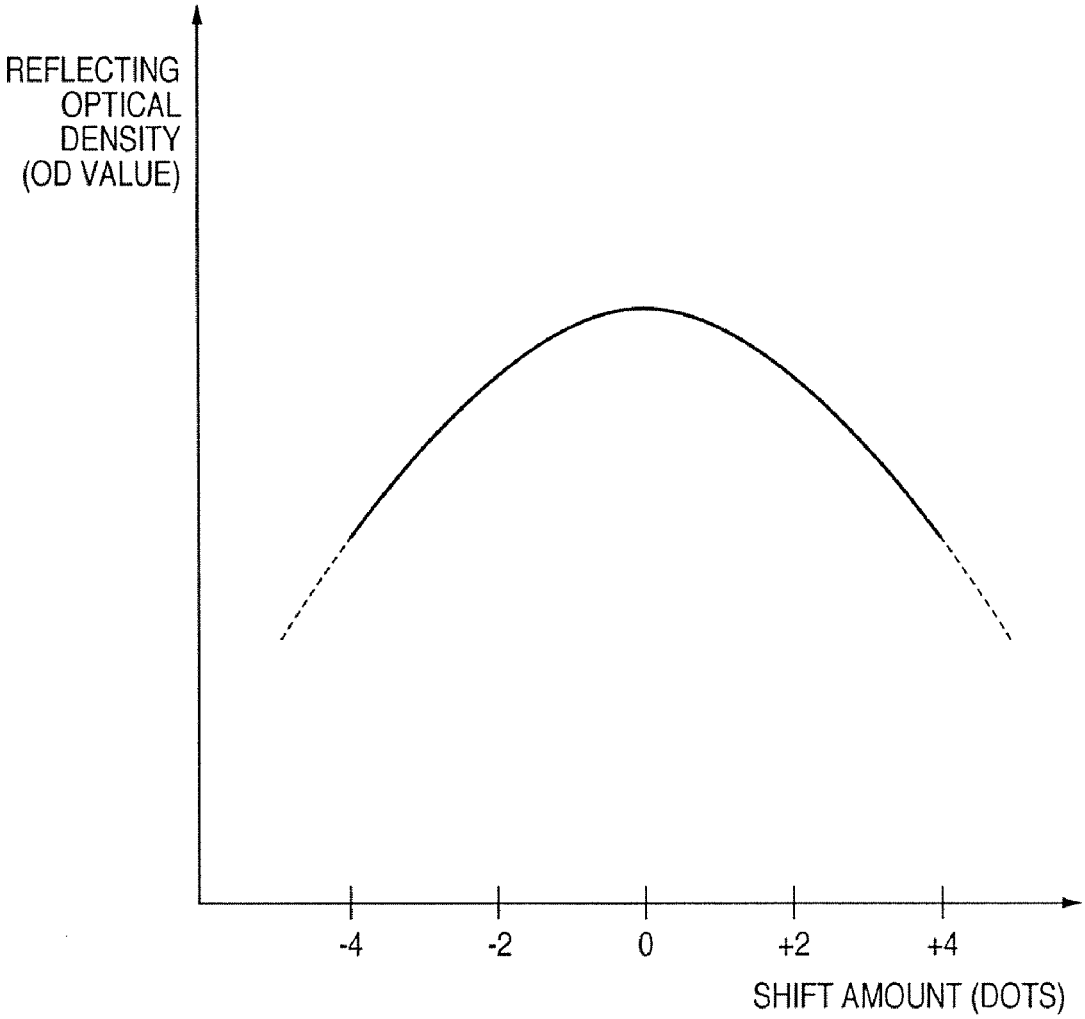
FIG. 6 is a diagram showing characteristics of output values of an optical sensor when test patterns are read.

FIG. 6 is a diagram showing characteristics of output values of an optical sensor when the test patterns shown in FIG. 5 are read. More specifically, the diagram shows values determined for each adjustment pattern after irradiating light from the optical sensor onto the patterns, receiving reflected light therefrom, and performing A/D conversion thereon. In this case, a relationship between a shift amount and an output value for each adjustment pattern is approximated by a polynomial, whereby a resulting curve is represented by a dotted line. Approximate values of each pattern on the dotted line are connected by a solid line.

Since the optical density of the pattern printed by reference dots and shift dots as measured by an optical sensor attains maximum density in an ideal printing state, a point where the reflection density (optical density) is a maximum on the aforementioned approximated curve can be determined as the adjustment value for adjusting the printing positions of forward and backward scans. Adjustment values in the present embodiment can be set in 1 dot-increments that are finer than the shift amount intervals applied when printing the test patterns shown in FIG. 5. Accordingly, a shift amount can be adjusted in one-dot increments so as to be closest to a point where the reflection density obtained from the approximated curve is a maximum, whereby the shift amount is taken as an adjustment amount.

The processing performed in step S130 for acquiring an adjustment value for adjusting printing positions in bidirectional printing has been described. However, the number of patterns in an adjustment pattern, the shift amount and settable adjustment value intervals (adjustment accuracy) are not limited to the configuration described above. For example, instead of performing a detailed approximation as shown in FIG. 6, a pattern indicating a maximum reflection density may be selected from a plurality of patterns for which reference dots and shift dots are relatively shifted in 2 dot-increments, whereby the shift amount of the selected pattern may be taken without modification as an adjustment amount.

Next, in step S140, in order to have the user perceive that the adjustment value acquisition was successful or to have the user perceive the adjustment value acquisition results, a confirmation pattern is printed using the adjustment value obtained in step S130. A ruled line pattern or the like that is easily perceivable by the user is used as the confirmation pattern. In addition, in the case where a bidirectional printing mode corresponding to a plurality of carriage travel speeds is available, confirmation patterns may be printed at the respective speeds. As seen, in the automatic dot adjustment value acquisition processing sequence, two printing patterns are printed, namely, an adjustment pattern for acquiring an adjustment value, and a confirmation pattern for confirming adjustment results.

Once printing of a confirmation pattern and subsequent confirmation thereof by the user are concluded in step S140, the sequence proceeds to step S150 where the CPU 101 stores the acquired adjustment value in a memory (the RAM 105 or the non-volatile memory 106) in the printing apparatus main body. The present embodiment is configured so that an acquired adjustment value overwrites the memory every time the automatic dot adjustment value acquisition processing sequence is executed. When performing normal image printing, the adjustment value stored in the memory in step S150 is read and printing is performed by adjusting printing positions according to the adjustment value. When performing the normal image printing, printing position adjustment may be performed, based on the acquired adjustment value, such that printing positions by one of two printing operations to be adjusted are changed. For example, when adjusting printing positions in forward and backward scans in bidirectional printing, a timing of discharging ink is changed only in the backward scan. By this operation, a printed dot position in the backward scan is changed, based on a printed dot in the forward scan. This results in adjusting the printing positions in the forward and backward scans.

In this manner, the automatic dot adjustment value acquisition processing sequence is concluded.

As described above, with the automatic dot adjustment value acquisition processing sequence according to the present embodiment, the series of processing can be performed automatically. Therefore, the judgment of the user will take no part in the processing in progress and the occurrences of judgmental and operational errors can be suppressed.

The above description of automatic dot adjustment value acquisition processing has been given using, as an example, a case of adjusting printing positions by forward and backward scans in bidirectional printing. However, as described above, the printing apparatus according to the present embodiment is configured so that dot adjustment value acquisition processing for adjusting printing positions by printing operations other than bidirectional printing may also be performed. For example, the print head applied in the present embodiment is provided with a plurality of orifice arrays for discharging ink of the same color and is also capable of performing dot adjustment value acquisition processing for adjusting printing positions of dots printed by each orifice array. Furthermore, the printing apparatus is also capable of performing dot adjustment value acquisition processing for adjusting printing positions of dots printed by a plurality of print heads that discharge inks of different colors. The present embodiment is also applicable to a case where, for example, the same print head is provided with orifice arrays that discharge the same color in different densities or different ink discharge amounts.

In either dot adjustment value acquisition processing, by using test patterns wherein, among two printing operations that perform printing position adjustment, reference dots are printed by one printing operation and shift dots are printed by the other printing operation, an adjustment value can be acquired through processes similar to those in the case of bidirectional printing. For example, in the case of adjusting printing positions of dots printed by two orifice arrays, an adjustment value can be acquired from an adjustment pattern wherein reference dots are printed by one of the orifice arrays and shift dots are printed by the other orifice array. In addition, in the case of adjusting printing positions of a plurality of print heads that respectively discharge inks of different colors, an adjustment value can be acquired from a test pattern wherein, for example, reference dots are printed by the black print head and shift dots are printed by the cyan print head. The printing positions of all colors can be adjusted using black as reference by respectively acquiring adjustment values for black and magenta and for black and yellow.

Furthermore, when performing a plurality of types of dot adjustment value acquisition processing, test patterns for acquiring the respective adjustment values may be arranged to be printed simultaneously. For example, a test pattern for dot adjustment value acquisition processing for bidirectional printing and a test pattern for dot adjustment value acquisition processing for each orifice array can be printed at the same time. An adjustment value can also be determined for each adjustment processing by reading densities of the respective test patterns using the same optical sensor.

The number of patterns in a test pattern, the increments of shift amounts and the settable adjustment value intervals (adjustment accuracy) can be independently set according to the purpose of each dot adjustment value acquisition processing.

Automatic dot adjustment value acquisition processing sequences performed for the second and subsequent times may be arranged so that test patterns are printed for which the shift amount is varied in a positive or negative direction when taking the previous adjustment value (shift amount) as the center of variation. Generally, with adjustment values acquired through dot adjustment value acquisition processing, it is unlikely that a significant misalignment will occur unless operations such as replacing a print head are carried out. In addition, the present embodiment is configured so that a newly obtained adjustment value overwrites the memory every time the automatic dot adjustment value acquisition processing sequence is performed. Therefore, for automatic dot adjustment value acquisition processing sequences performed for the second and subsequent times, a configuration shall suffice wherein adjustment is performed using adjustment patterns for which the variation widths among test patterns are reduced from the previous adjustment value (shift amount) that is taken as the center of variation. As a result, the number of patterns to be printed for dot adjustment value acquisition processing can be reduced, and in turn, the amount of time required for dot adjustment value acquisition processing can be reduced.

Moreover, with the automatic dot adjustment value acquisition processing described above, test patterns are preferably printed in ink whose color has excellent light absorption characteristics with respect to the color emitted by the LED that is used as an optical sensor. For example, in the case where an optical sensor employing a red or infrared LED is used, in consideration of the absorption characteristics with respect to red or infrared, test patterns printed in black or cyan are capable of acquiring density characteristics and S/N ratios with maximum sensitivity. Consequently, in dot adjustment value acquisition processing according to the present embodiment, test patterns are printed in black or cyan ink using an optical sensor employing a red or infrared LED.

However, the use of a red or infrared LED as the optical sensor is not restrictive with respect to the present invention. For example, by mounting a blue LED or a green LED together with a red LED, density characteristics and S/N ratios can be acquired with favorable sensitivity for all colors, thereby enabling adjustment of printing positions of print heads that discharge ink of the respective colors with higher accuracy.

Next, a procedure for acquiring an adjustment value through manual dot adjustment value acquisition processing will be described as an application example of the "normal dot adjustment value acquisition processing mode".

The automatic dot adjustment value acquisition processing is an open-loop control dependent on detection results from the optical sensor. Therefore, adjustment will be performed among a state wherein various error factors exist such as an environment in which test patterns are printed or the states of the printing apparatus and print heads or the optical sensor at various time points. Thus, automatic dot adjustment value acquisition processing is not well-suited for acquiring adjustment values with high accuracy. Conversely, since adjustment is performed one step at a time according to user judgment in manual dot adjustment value acquisition processing, even when error factors exist, it is possible to perform adjustment processing while feeding back such error factors. As a result, adjustment values can be acquired with high accuracy.

Figure 7:
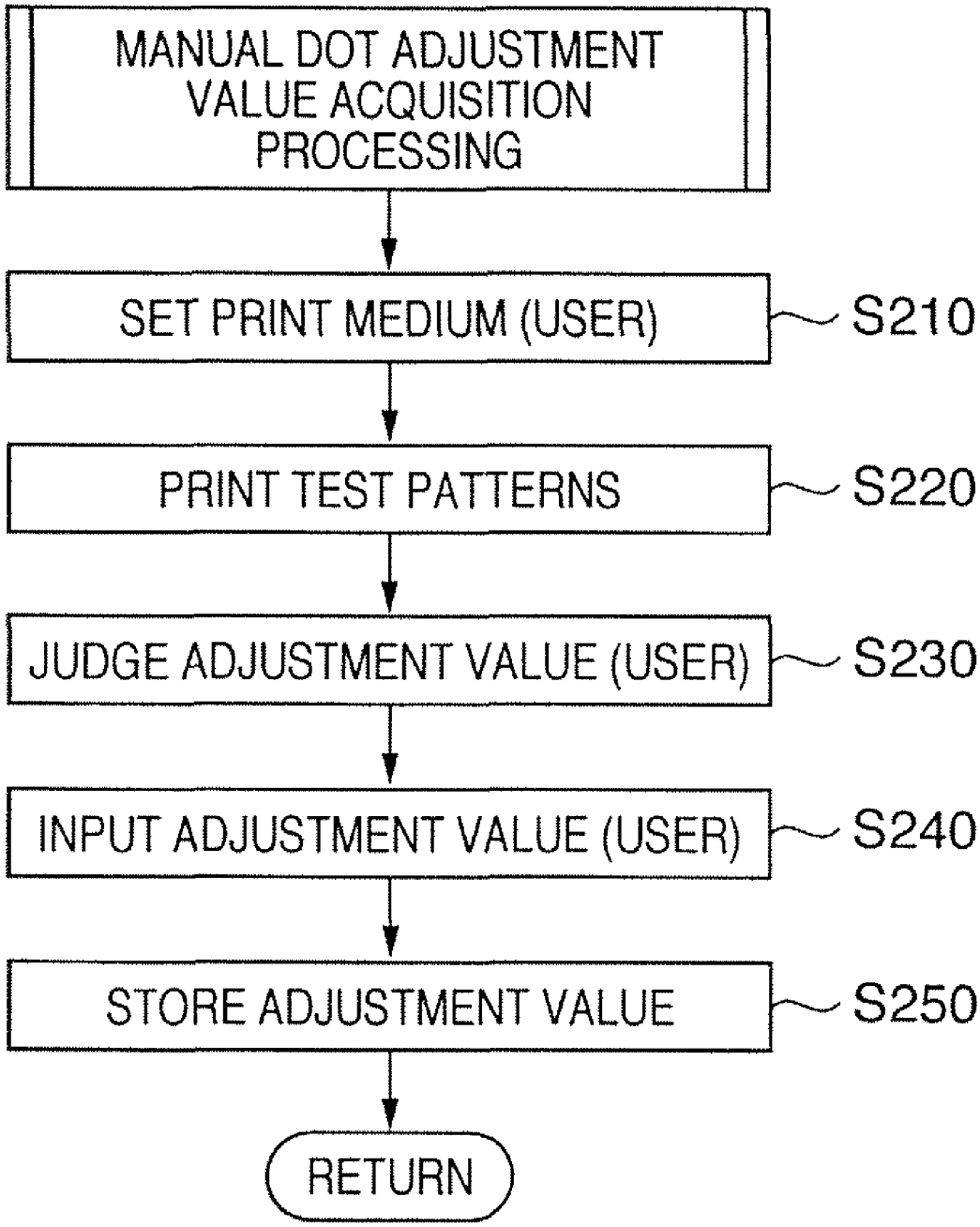
FIG. 7 is a flowchart showing a flow of a series of processes performed by a CPU and a user in manual dot adjustment value acquisition processing in an embodiment of the present invention.

FIG. 7 is a flowchart showing a flow of a series of process steps in manual dot adjustment value acquisition process in the present embodiment. Here, a description will be given using, as an example, a case of adjusting printing positions by forward and backward scans in bidirectional printing by manual dot adjustment value acquisition processing.

In FIG. 7, when a manual dot adjustment value acquisition processing sequence is initiated, in step S210, the user first sets a print medium on the printing apparatus main body and issues an instruction to commence printing of test patterns via a menu of a printer driver or the like.

Once the printing commencement command is inputted, the sequence proceeds to step S220 where the printing apparatus prints test patterns. The test patterns printed at this point may be test patterns whose reflecting optical densities vary according to variations in shift amounts such as those shown in FIG. 5, or may be test patterns constituted by ruled line patterns such as those shown in FIG. 8.

Figure 8:
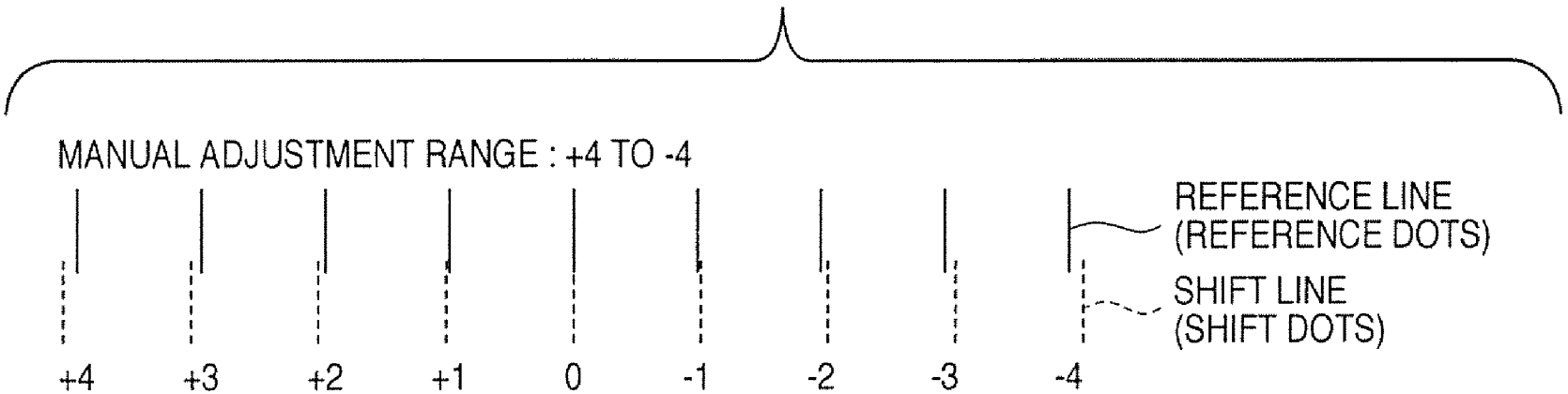
FIG. 8 is a diagram showing examples of test patterns for manual dot adjustment value acquisition processing.

In order to print test patterns such as those shown in FIG. 8, a plurality of reference lines (reference dots) is first printed by a forward scan in the scan direction at certain intervals. Next, in a backward scan, the same number of shift lines (shift dots) as the reference lines is printed by varying the relative shift amount with the reference lines.

In the subsequent step S230, the user observes the outputted test patterns, selects a ruled line pattern that either forms a straight line or most closely resembles a straight line, and judges an adjustment value most appropriate for adjusting printing positions. In the case where the test patterns printed in step S220 are test patterns wherein reflecting optical densities vary according to shift amounts (such as those shown in FIG. 5), by selecting an adjustment pattern that appears to be most uniform, the user is able to determine the shift amount applied when the pattern was printed as the adjustment value.

In step S240, the user inputs the selected adjustment value from the menu of the printer driver or the like.

Upon input confirmation, the CPU 101 stores the obtained value in a memory such as the RAM 105 (step S250). Note that an area in which the adjustment value acquired by the present manual dot adjustment value acquisition processing sequence is stored differs from the area storing an adjustment value acquired by the aforementioned automatic dot adjustment value acquisition processing sequence.

In this manner, the manual dot adjustment value acquisition processing sequence is concluded.

As seen, manual dot adjustment value acquisition processing is a method wherein adjustment of printing positions is performed by having the user him/herself observe test patterns and judge an adjustment value and, as such, the reliability of the adjustment depends on the user's judgment. Therefore, for a novice user unfamiliar with printing apparatuses, the present adjustment processing may turn out to be a difficult and uncertain procedure. However, for a user well-accustomed to handling a printing apparatus, since printing positions can be adjusted based on the user's own judgment, the method is actually more reliable.

Furthermore, with automatic dot adjustment value acquisition processing using an optical sensor, there may be cases where, depending on the color of emitted light, performing adjustment processing will prove to be difficult for certain ink colors or adjustment processing may only be performed on a limited range of colors. As described above, while a plurality of sensors may be provided in order to accommodate all ink colors, this will inevitably increase the cost of the printing apparatus. On the other hand, manual dot adjustment value acquisition processing has no such problem, and is therefore capable of reliably performing adjustment processing on almost all colors.

The above description of manual dot adjustment value acquisition processing has been given using, as an example, a case of adjusting printing positions by forward and backward scans in bidirectional printing. However, the printing apparatus according to the present embodiment is arranged so that dot adjustment value acquisition processing other than for bidirectional printing may also be simultaneously performed through manual dot adjustment value acquisition processing. Furthermore, for example, when executing dot adjustment value acquisition processing among different orifice arrays, test patterns for adjusting printing positions in bidirectional printing and test patterns for adjusting printing positions among the different orifice arrays may be printed at the same time.

When a manual dot adjustment value acquisition processing sequence is next executed, test patterns may be printed for which shift amounts are varied in the positive and negative directions from the adjustment value acquired in the previous processing that is taken as the center of variation. Furthermore, the area in which an adjustment value acquired through a manual dot adjustment value acquisition processing sequence is stored differs from the area storing an adjustment value acquired through an automatic dot adjustment value acquisition processing sequence. Therefore, for manual dot adjustment value acquisition processing performed for the second and subsequent times, adjustment patterns may be printed wherein the shift amount is reduced with respect to the adjustment value acquired by the previous manual dot adjustment value acquisition processing that is taken as the center of variation.

Such a configuration enables the number of patterns to be printed for dot adjustment value acquisition processing to be reduced, and in turn, the amount of time required for dot adjustment value acquisition processing can be reduced.

As heretofore described, through the use of plain paper that is inexpensive and relatively easy to obtain as the print medium used for adjustment processing, the "normal dot adjustment value acquisition processing mode" accommodates the needs of users who prefer simple printing position adjustment over high accuracy printing position adjustment. It should be noted that printing position adjustment through both "automatic dot adjustment value acquisition processing" and "manual dot adjustment value acquisition processing" can be performed in the "normal dot adjustment value acquisition processing mode". However, in order to realize printing position adjustment that is more readily performed than high accuracy printing position adjustment, it is preferable to use "automatic dot adjustment value acquisition processing" wherein adjustment of dot printing positions is automatically performed using an optical sensor.

(High Accuracy Dot Adjustment Value Acquisition Processing Mode)

A description of the "high accuracy dot adjustment value acquisition processing mode" according to the present embodiment will now be given.

A feature of the "high accuracy dot adjustment value acquisition processing mode" according to the present embodiment is that printing position adjustment is performed using coated paper. The "high accuracy dot adjustment value acquisition processing mode" is primarily arranged to accommodate the needs of high-end users familiar with the handling of printing apparatuses who wish to perform printing position adjustment with high accuracy.

The reason for using coated paper in the "high accuracy dot adjustment value acquisition processing mode" for adjusting printing positions with high accuracy will now be described.

To begin with, in the case of plain paper that is used in the "normal dot adjustment value acquisition processing mode", upon landing on a sheet of plain paper, an ink droplet spreads out in every direction along the paper fiber. Although dye molecules or pigment molecules that are colored components adhere to the fiber during the spreading process, since the adherence between the dye molecules or pigment molecules and the fiber is not strong, it is difficult for the color components to remain on the paper surface. As a result, the optical reflection density of an image printed on plain paper is likely to be low.

Furthermore, with plain paper, since ink travels along the direction of the fiber, a dot formed by a landed ink droplet will have a distorted shape.

Therefore, when the above-described characteristics of plain paper are taken into consideration, plain paper can be described as being ill-suited for dot adjustment value acquisition processing. Nevertheless, plain paper is generally used due to its low cost as a print medium. When printing test patterns at a printing resolution of around 1200 dpi, dot adjustment value acquisition processing can be performed with sufficient accuracy using plain paper. Accordingly, dot adjustment value acquisition processing using plain paper is performed by actual products.

However, in the case where a high adjustment accuracy or, more specifically, an adjustment accuracy of 2400 dpi (approx. 10 μm) or 4800 dpi (approx. 5 μm) is required, obtaining accurate adjustment values using plain paper will be extremely difficult.

Figure 9:
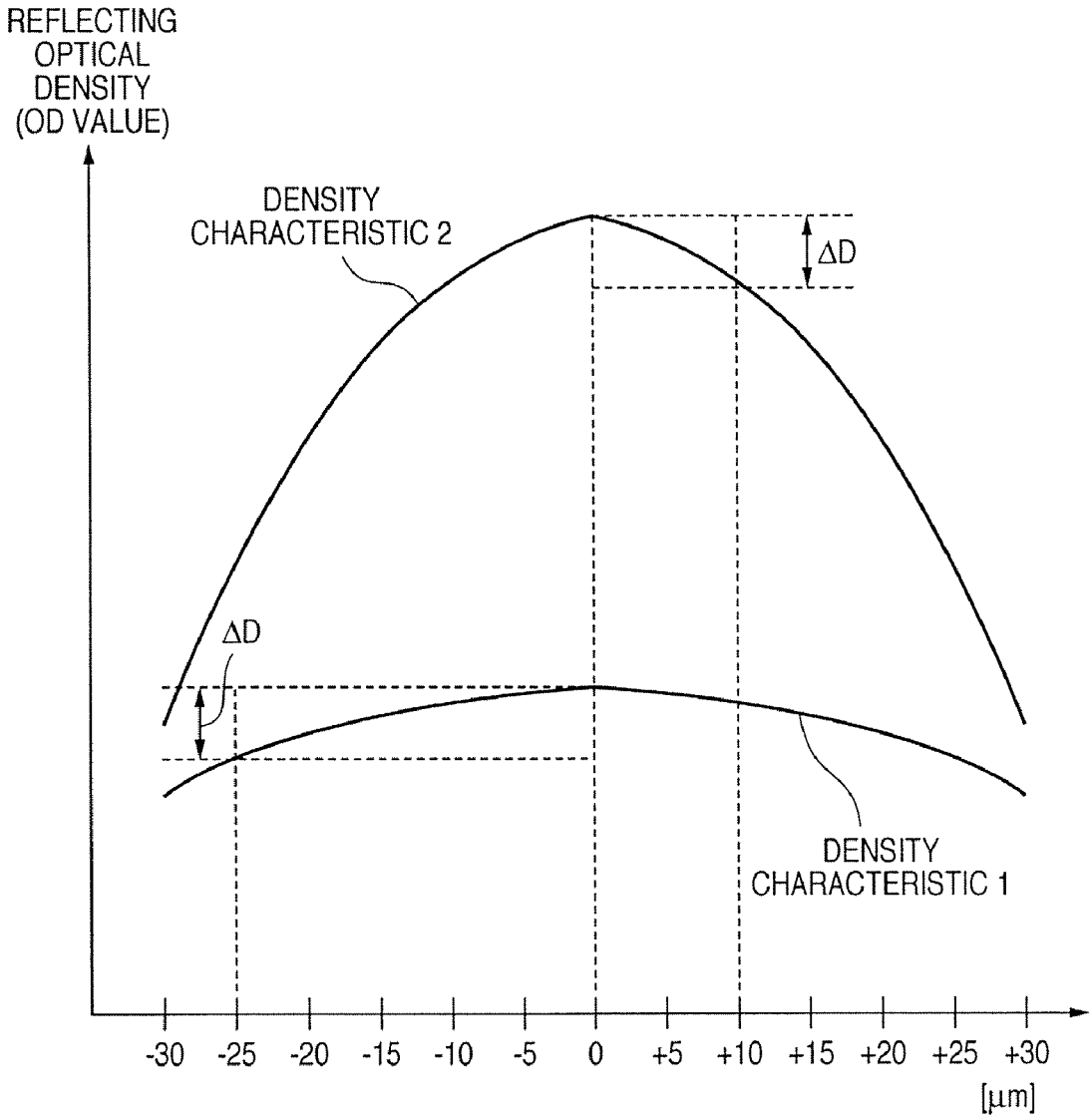
FIG. 9 is a diagram showing characteristics of output values of an optical sensor when reading test patterns of respective print mediums used in an embodiment of the present invention.

FIG. 9 shows reflecting optical densities when shift amounts are varied during the printing of the test patterns shown in FIG. 5. In FIG. 9, density characteristic 1 represents the optical density characteristic of plain paper while density characteristic 2 represents the optical density characteristic of coated paper. In FIG. 9, shift amounts are denoted in μm instead of in dots.

With adjustment patterns, it is necessary to vary the shift amount of shift dots with respect to reference dots so that sufficient optical density differences may be obtained among the patterns. Therefore, in the case of automatic dot adjustment value acquisition processing, the variation width of shift amounts is designed in consideration of the reading accuracy of optical sensors so that sufficient optical density differences may be obtained among the patterns. In addition, in the case of manual dot adjustment value acquisition processing, the variation width of shift amounts is designed in consideration of visual capacities of humans.

As is apparent from FIG. 9, when using plain paper (density characteristic 1), the shift amount must be varied by approximately 25 μm in order to obtain a given optical density difference ΔD. Conversely, when using coated paper (density characteristic 2), the shift amount variation necessary for obtaining the optical density difference ΔD is approximately 10 μm.

As shown, in comparison to plain paper, since sufficient optical density variations can be obtained with coated paper even when the shift amount is finely varied, coated paper can be described as having high S/N ratio characteristics.

In addition, with plain paper, since landed dots take distorted shapes, it is difficult to narrow down shift amounts between reference lines and shift lines particularly in test patterns constituted by ruled line patterns. The present inventors are empirically aware that the visually discernible limit of ruled line misalignment is from 40 to 50 μm.

Due to the reasons described above, in "high accuracy dot adjustment value acquisition processing mode" according to the present embodiment, printing position adjustment using coated paper is performed in order to adjust printing positions with high accuracy.

In addition, with the "high accuracy dot adjustment value acquisition processing mode" according to the present embodiment, test patterns are used whose reflecting optical densities vary according to shift amounts are used. Through "manual dot adjustment value acquisition processing", the user himself/herself observes test patterns and determines an adjustment value. The "high accuracy dot adjustment value acquisition processing mode" is arranged to accommodate the needs of high-end users familiar with the handling of printing apparatuses who wish to perform printing position adjustment with high accuracy. Therefore, by adopting "manual dot adjustment value acquisition processing" wherein adjustment processing is performed while feeding back error factors in the adjustment process high accuracy adjustment processing is provided.

Figure 10:
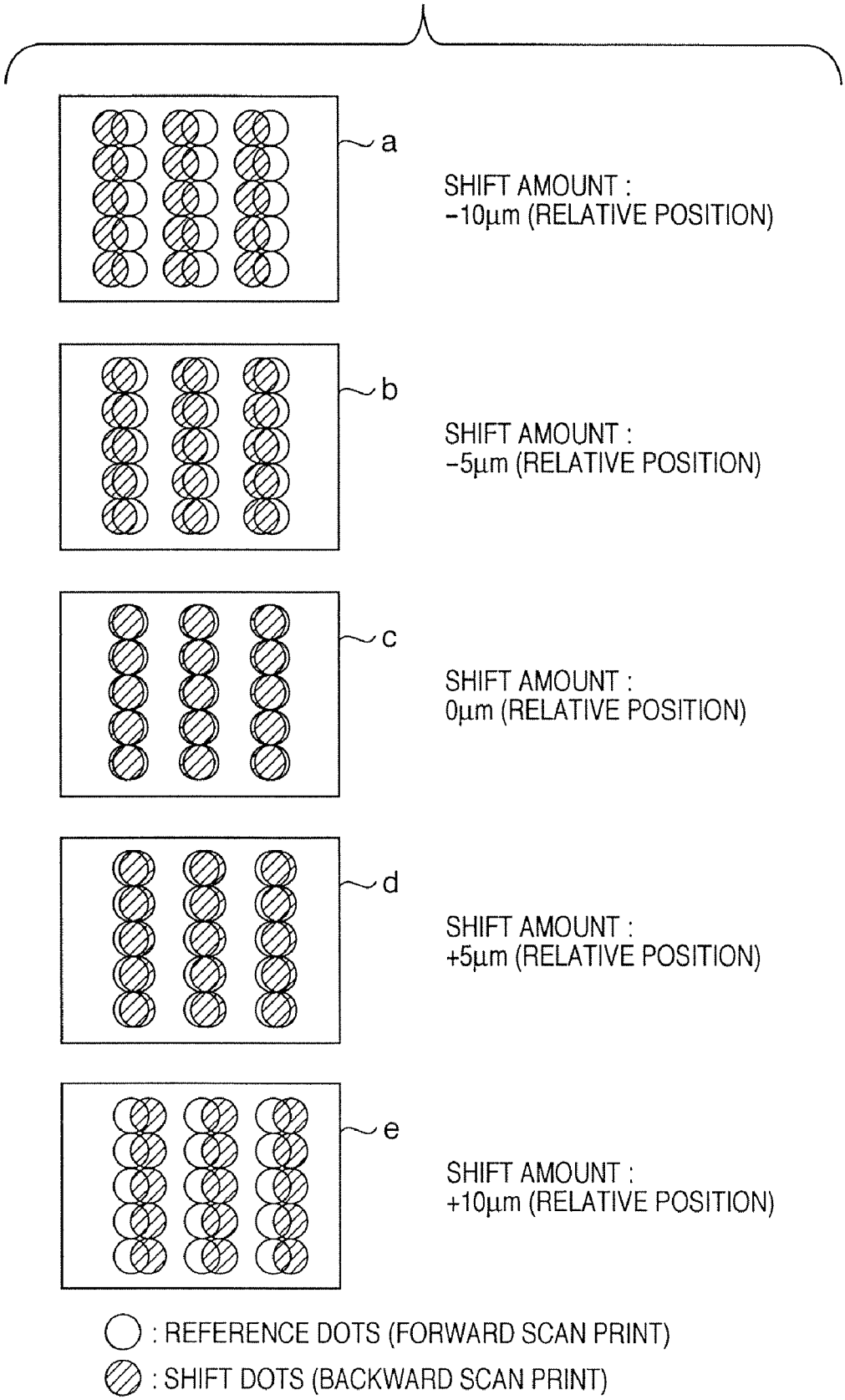
FIG. 10 is a diagram showing portions of test patterns for high accuracy dot adjustment value acquisition processing.

Next, test patterns to be used in high accuracy dot adjustment value acquisition processing will now be described. FIG. 10 is a diagram showing examples of test patterns used in the processing. In FIG. 10, white dots are assumed to be reference dots printed in a forward scan print, and hatched dots are assumed to be shift dots printed in a backward scan. In the high accuracy adjustment patterns shown in FIG. 10, a plurality of adjustment patterns are printed by setting the shift amount of shift dots with respect to the reference dots to 5 μm-intervals and varying the shift dots in five stages.

Similar to those shown in FIG. 5, the test patterns shown in FIG. 10 are adjustment patterns whose respective optical reflection densities vary according to variations in the relative shift amounts between reference dots and shift dots. However, the test patterns differ from the adjustment patterns shown in FIG. 5 in the positional relationships between reference dots and shift dots in an ideal printing state. With the test patterns shown in FIG. 10, an ideal printing state is a state wherein hatched dots that are reference dots and white dots that are shift dots completely overlap each other.

Therefore, in "high accuracy dot adjustment value acquisition processing", by having the user select a pattern with the lowest optical reflection density from adjustment patterns resembling those shown in FIG. 10, an adjustment value can be determined from the shift amount of the pattern.

However, using the shift amount of the selected pattern as an adjustment value without modification may result in imperfect overlapping of the reference dots and the shift dots in the selected pattern and, in the case of a misalignment, such a misalignment cannot be adjusted. For example, in the case of FIG. 10, although the adjustment pattern shown in FIG. 10*c* will be selected, the misalignments between the reference dots and the shift dots shown in FIG. 10*c* will also be retained even after adjustment. In the present embodiment, since test patterns are printed by varying the shift amount of the shift dots with respect to the reference dots in 5 μm-increments, maximum misalignments of 5 μm will be retained. In consideration thereof, the shift amount of the shift dots with respect to the reference dots in test patterns should be set according to the required adjustment accuracy.

With "high accuracy dot adjustment value acquisition processing" wherein adjustment values are acquired using this test pattern, it is preferable that normal dot adjustment value acquisition processing has already been performed prior to the adjustment processing and that printing position adjustment with normal accuracy has already been concluded. With the test patterns used in "high accuracy dot adjustment value acquisition processing", shift amounts are varied in fine increments (5 μm). Therefore, as long as normal dot adjustment value acquisition processing has already been concluded, a range in which shift amounts are varied can be restricted and, in turn, the number of necessary patterns may be reduced.

Figure 11:
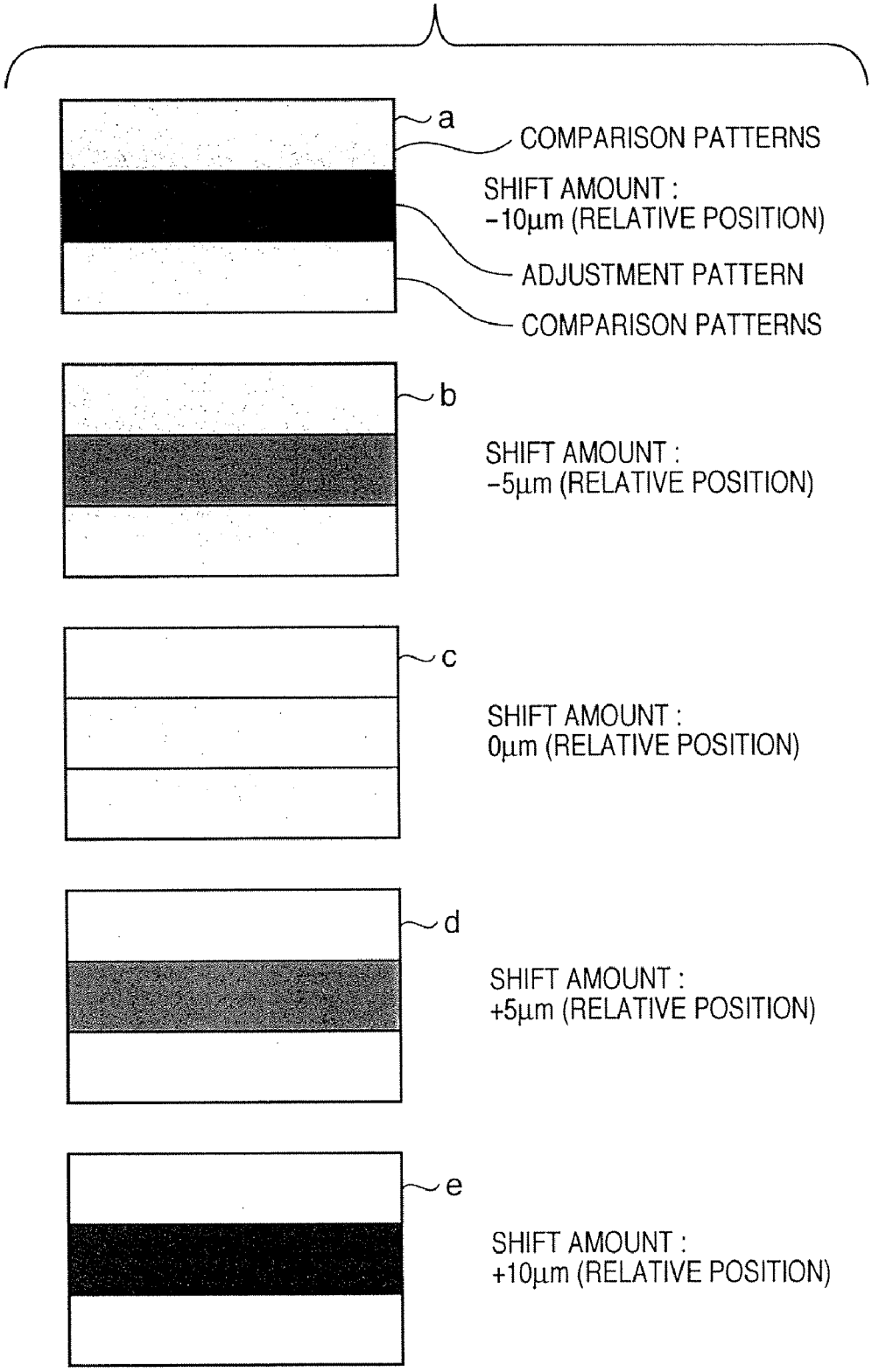
FIG. 11 is a diagram showing entire test patterns for high accuracy dot adjustment value acquisition processing.

In addition, the test patterns used in "high accuracy dot adjustment value acquisition processing" are preferably printed with comparison patterns disposed adjacent to each adjustment pattern as shown in FIG. 11. A comparison pattern represents dot displacements when reference dots and shift dots are printed in an ideal printing state and is printed so that reference dots made by two printing operations overlap each other at the same positions. By providing each adjustment pattern with a comparison pattern in this manner, the user will be able to visually judge patterns that are in an ideal printing state more easily. In addition, the user need only select an adjustment pattern at a point where the adjustment pattern and its comparison pattern form a uniform image.

As described above, by performing adjustment processing using coated paper, the "high accuracy dot adjustment value acquisition processing mode" is primarily arranged to accommodate the needs of high-end users familiar with the handling of printing apparatuses who wish to perform printing position adjustment with high accuracy.

Particularly, performing printing position adjustment using coated paper enables printing position adjustment at higher accuracy and, in turn, enables higher quality image printing.

In the "high accuracy dot adjustment value acquisition processing mode" according to the present embodiment, automatic printing position adjustment using an optical sensor can also be performed through "automatic dot adjustment acquisition processing".

(Dot Adjustment Value Acquisition Processing Mode Selection Sequence)

Figure 12:
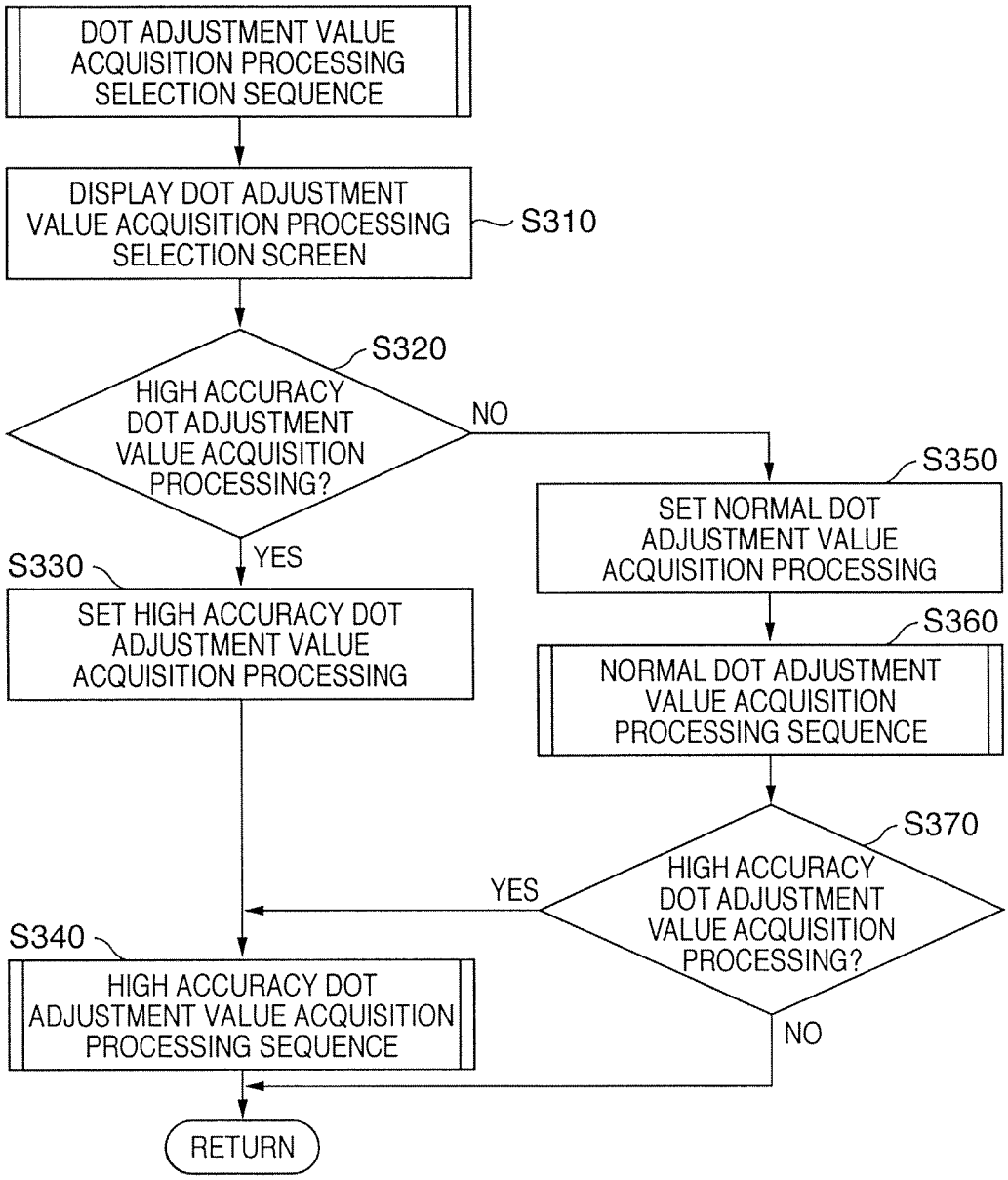
FIG. 12 is a flowchart showing a dot adjustment value acquisition processing mode selection sequence applied in an embodiment of the present invention.

Next, a dot adjustment value acquisition processing mode selection sequence will be described. FIG. 12 is a flowchart showing a dot adjustment value acquisition processing mode selection sequence. As is apparent from the flowchart, a feature of the configuration of the present embodiment is that printing position adjustment can be executed in both "normal dot adjustment value acquisition mode" and "high accuracy dot adjustment value acquisition mode". According to this configuration, it is now possible to provide printing position adjustment capable of accommodating the diverse needs of users ranging from those familiar with using printing apparatuses who desire high accuracy adjustment of printing positions to novice users who wish to adjust printing positions in an easy manner.

In the dot adjustment value acquisition processing mode selection sequence according to the present embodiment, a utility screen of a printer driver is displayed on the display screen of the host apparatus to have the user select a dot adjustment value acquisition processing mode.

First, in step S310, the printer driver in the host apparatus displays a dot adjustment value acquisition processing selection screen on the display screen of the host apparatus to enable the user to select and instruct a dot adjustment value acquisition processing mode.

In step S320, the printer driver judges whether the dot adjustment value acquisition processing mode selected by the user is the high accuracy dot adjustment value acquisition processing mode.

If the printer driver judges in step S320 that the high accuracy dot adjustment value acquisition processing mode has been selected, the printer driver proceeds to step S330 to set the printing apparatus so that printing position adjustment will be performed in the high accuracy dot adjustment value acquisition processing mode.

Upon input of an execution command for the high accuracy dot adjustment value acquisition processing mode into the printing apparatus, in step S340, the CPU 101 executes a high accuracy dot adjustment value acquisition processing sequence and performs printing position adjustment in the high accuracy dot adjustment value acquisition processing mode.

On the other hand, if the printer driver judges in step S320 that the high accuracy dot adjustment value acquisition processing mode has not been selected, the printer driver proceeds to step S350 to set the printing apparatus so that printing position adjustment will be performed in the normal dot adjustment value acquisition processing mode (having a lower accuracy than the high accuracy mode).

Upon input of an execution command for the normal dot adjustment value acquisition processing mode into the printing apparatus, in step S360, the CPU 101 executes a normal dot adjustment value acquisition processing sequence and performs printing position adjustment in the normal dot adjustment value acquisition processing mode.

Once the normal dot adjustment value acquisition processing sequence is concluded, the processing flow proceeds to step S370. In step S370, a selection is made on whether printing position adjustment in the high accuracy dot adjustment value acquisition processing mode will be performed after executing printing position adjustment in the normal dot adjustment value acquisition processing mode. When high accuracy dot adjustment value acquisition processing is to be performed, the processing flow proceeds to step S370 to execute a high accuracy dot adjustment value acquisition processing sequence. When high accuracy dot adjustment value acquisition processing will not be performed, the dot adjustment value acquisition processing mode selection sequence is concluded.

In this manner, the dot adjustment value acquisition processing mode selection sequence is concluded.

As described, the present embodiment has a plurality of dot adjustment value acquisition processing modes and is able to provide dot adjustment value acquisition processing according to user needs. In addition, through the high accuracy dot adjustment value acquisition processing mode, printing position adjustment with high accuracy is possible and high quality image printing can be achieved. Note that dot adjustment value acquisition processing modes are not limited to just two modes as is the case with the present embodiment, and a larger number of modes can also be provided.

(High Accuracy Dot Adjustment Value Acquisition Processing Sequence)

Next, a "high accuracy dot adjustment value acquisition processing sequence" that is a sequence used when performing printing position adjustment in the high accuracy dot adjustment value acquisition processing mode will be described.

Figure 13:
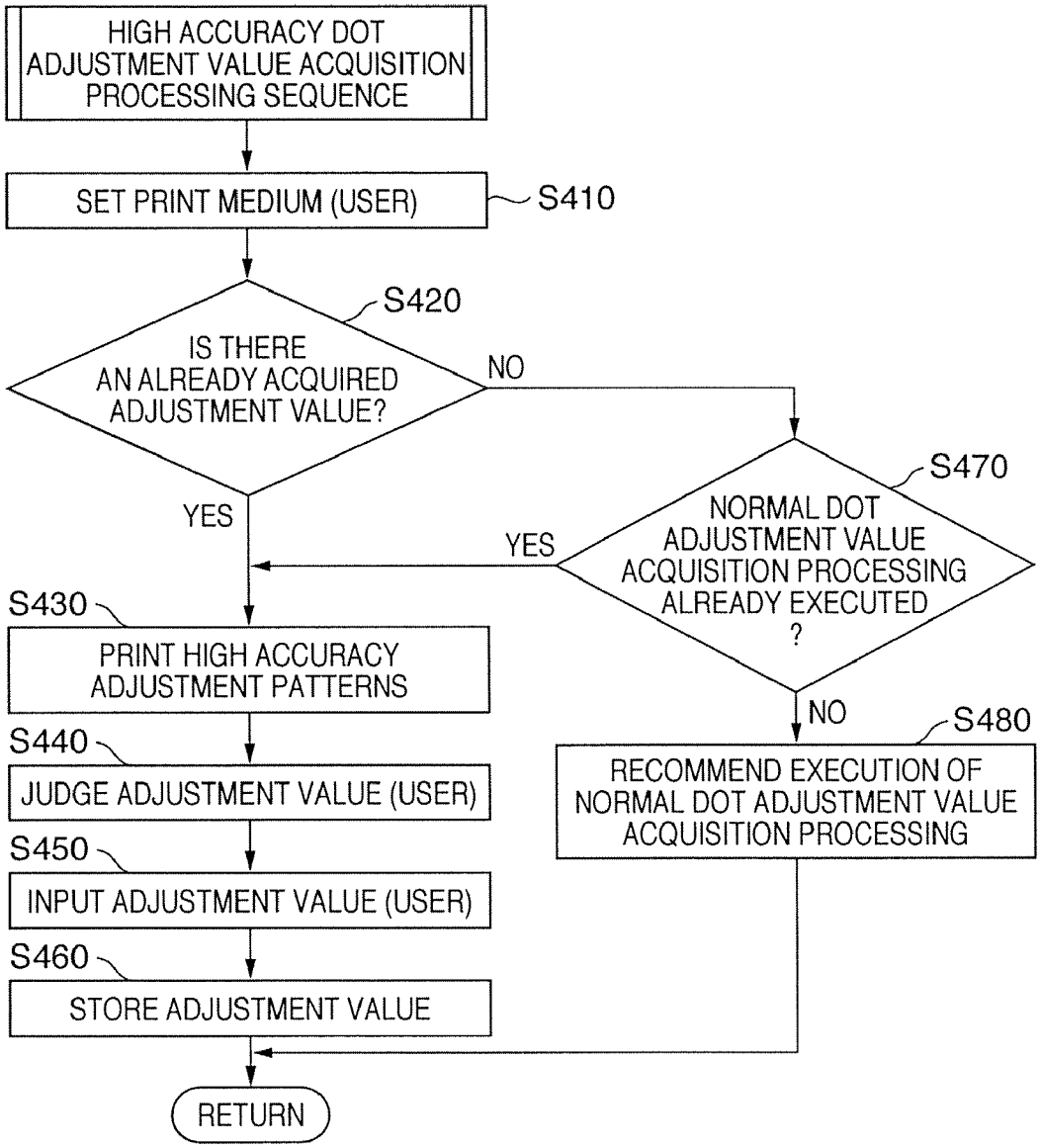
FIG. 13 is a flowchart showing a high accuracy dot adjustment value acquisition processing sequence applied in an embodiment of the present invention.

In the "high accuracy dot adjustment value acquisition processing mode" according to the present embodiment, dot adjustment value acquisition processing is performed using coated paper. FIG. 13 is a flowchart showing a flow of a series of processing steps when performing printing position adjustment in the high accuracy dot adjustment value acquisition processing mode according to the present embodiment.

In FIG. 13, when a high accuracy dot adjustment value acquisition processing sequence is initiated, in step S410, the user first sets a print medium on the printing apparatus and issues an instruction to commence printing of test patterns via a menu of a printer driver or the like. In this case, coated paper is used as the paper medium.

Once a printing commencement command is inputted, the sequence proceeds to step S420 to confirm whether an adjustment value has already been acquired. If printing position adjustment in the high accuracy dot adjustment value acquisition processing mode has been previously performed, as described earlier, the number of patterns in a test pattern can be reduced by using the adjustment value acquired in the previous processing.

In the case where there is an adjustment value acquired in step S420, the printing apparatus prints test patterns based on the acquired adjustment value (step S430). The test patterns printed at this point are test patterns whose reflecting optical densities vary in accordance with variations in the shift amounts of shift dots with respect to reference dots as shown in FIG. 10.

In the subsequent step S440, the user observes the outputted test patterns and judges an adjustment value. When the test patterns printed in step S430 resemble those shown in FIG. 11, an adjustment pattern having the same density as a comparison pattern or, in other words, an adjustment pattern for which the adjustment pattern and the comparison pattern thereof appear to be most uniform is selected.

In step S450, the user inputs a parameter indicating the selected pattern (an adjustment value or a numeral indicating the selected adjustment pattern) from the menu of the printer driver or the like. Upon input confirmation, in step S460, the CPU 101 stores the adjustment value in a memory such as the RAM 105 based on the inputted parameter. Note that the area in which an adjustment value acquired in the present high accuracy dot adjustment value acquisition processing mode is stored differs from the area storing an adjustment value acquired in the aforementioned normal dot adjustment value acquisition processing mode.

In this manner, the present sequence is concluded.

Meanwhile, when an already acquired adjustment value does not exist in step S420, the sequence jumps to step S470 to confirm whether printing position adjustment has already been executed in the normal dot adjustment value acquisition processing mode. When printing position adjustment has already been executed in the normal dot adjustment value acquisition processing mode, the sequence proceeds to step S430 to execute printing position adjustment in the high accuracy dot adjustment value acquisition processing mode. Incidentally, in the case where the acquired adjustment value is equal to the factory default value, there is a possibility that this loop will be formed. In consideration thereof, the execution or non-execution of normal dot adjustment value acquisition processing is confirmed in step S470. Therefore, a configuration is assumed wherein information associated with the execution or non-execution of normal dot adjustment value acquisition processing is stored in a storage medium such as a RAM or an EEPROM. In the case where printing position adjustment has not been executed in the normal dot adjustment value acquisition processing mode, in step S480, a recommendation for executing printing position adjustment in the normal dot adjustment value acquisition processing mode is made and the present sequence is subsequently concluded.

In the high accuracy dot adjustment value acquisition processing mode, printing position adjustment is performed using coated paper that is generally more expensive than plain paper. Therefore, it is desirable to prevent waste in coated paper in the case where accurate adjustment cannot be achieved when printing position adjustment is performed in the high accuracy dot adjustment value acquisition processing mode without performing printing position adjustment in the normal dot adjustment value acquisition processing mode, only to start all over again from normal dot adjustment value acquisition processing. Accordingly, in step S470, confirmation is performed on whether execution of printing position adjustment in the normal dot adjustment value acquisition processing mode has been performed. This ensures that printing position adjustment in the high accuracy dot adjustment value acquisition processing mode is performed after performing printing position adjustment in the normal dot adjustment value acquisition processing mode.

As described above, a feature of the present embodiment is that the "normal dot adjustment value acquisition mode" and the "high accuracy dot adjustment value acquisition mode" can be executed. Consequently, it is now possible to provide printing position adjustment that is capable of accommodating diversified needs of users ranging from those who desire high accuracy adjustment of printing positions to those who wish to adjust printing positions in an easy manner. In addition, providing the "high accuracy dot adjustment value acquisition mode" wherein printing position adjustment is performed using coated paper enables printing position adjustment at high accuracy and, in turn, enables high quality image printing.

It should be noted that the combination of print mediums used in the "normal dot adjustment value acquisition processing mode" and the "high accuracy dot adjustment value acquisition processing mode" is not limited to plain paper and coated paper. In other words, any combination of print mediums may be used as long as printing position adjustment in the "high accuracy dot adjustment value acquisition processing mode" is achieved at a higher adjustment accuracy than in the "normal dot adjustment value acquisition processing mode". However, when printing position adjustment is performed using an optical sensor, glossy paper and the like having a high reflectance is unsuitable for use in high accuracy printing position adjustment due to the increased reflectance at the print medium surface. In consideration of the above, the "high accuracy dot adjustment value acquisition processing mode" according to the present embodiment performs printing position adjustment using coated paper.

(Modification of the Dot Adjustment Value Acquisition Processing Mode Selection Sequence)

Next, a modification of the dot adjustment value acquisition processing mode selection sequence will be described. In the "high accuracy dot adjustment value acquisition processing mode" according to the present embodiment, execution of printing position adjustment in the high accuracy dot adjustment value acquisition processing mode is confirmed with the user prior to execution thereof. After confirmation, printing position adjustment is executed in the high accuracy dot adjustment value acquisition processing mode.

Figure 14:
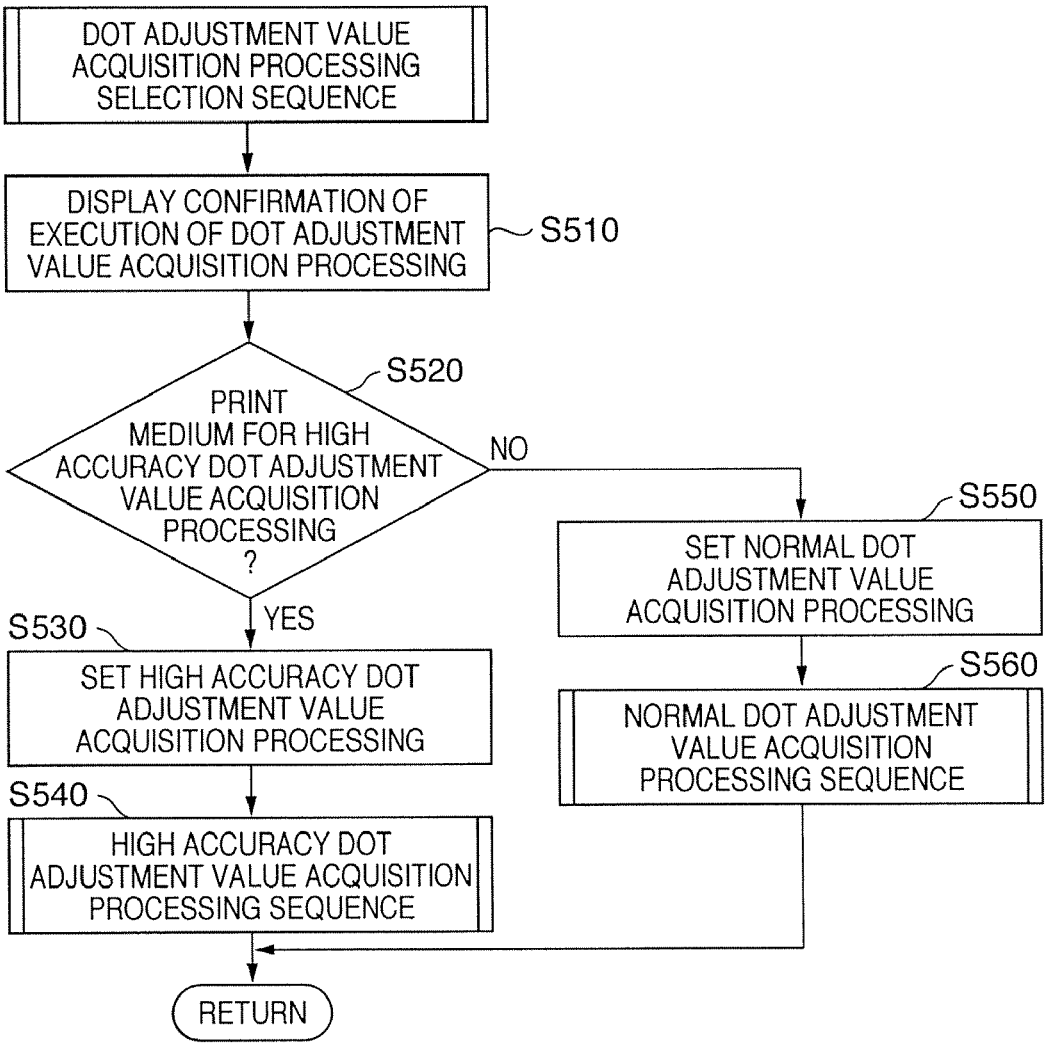
FIG. 14 is a flowchart showing a variation of the dot adjustment value acquisition processing mode selection sequence applied in an embodiment of the present invention.

FIG. 14 is a flowchart showing a dot adjustment value acquisition processing mode selection sequence through which the user selects either of two dot adjustment value acquisition processing methods. In this case, an example is shown wherein a utility screen of a printer driver or the like is displayed on the display screen of a host apparatus to enable selection of a dot adjustment value acquisition processing mode. First, in step S510, the printer driver causes a display to be performed on the screen of the host apparatus in order to confirm the execution of dot adjustment value acquisition processing with the user. In step S520, the user sets a print medium on the printing apparatus and selects the type of the set print medium. The printer driver judges whether the selected print medium is suitable for high accuracy dot adjustment value acquisition processing. Since coated paper is used in the "high accuracy dot adjustment value acquisition processing mode" in the present embodiment, a judgment is made on whether the print medium is coated paper.

If the printer driver judges in step S520 that a print medium suitable for printing position adjustment in the high accuracy dot adjustment value acquisition processing mode has been set, the sequence proceeds to step S530 to set the printing apparatus so that printing position adjustment in the high accuracy dot adjustment value acquisition processing mode will be performed.

Upon input of an execution command for high accuracy dot adjustment value acquisition processing, in step S540, the CPU 101 executes the high accuracy dot adjustment value acquisition processing sequence described earlier to perform printing position adjustment in the high accuracy dot adjustment value acquisition processing mode.

On the other hand, if the printer driver judges in step S520 that a print medium suitable for the high accuracy dot adjustment value acquisition processing mode has not been set, the sequence proceeds to step S550 where the printer driver sets the printing apparatus so that printing position adjustment in the normal dot adjustment value acquisition processing mode will be performed.

Upon input of an execution command for normal dot adjustment value acquisition processing, in step S560, the CPU 101 executes either the automatic dot adjustment value acquisition processing sequence or the manual dot adjustment value acquisition processing sequence described earlier.

In this manner, the dot adjustment value acquisition processing mode selection sequence is concluded.

As described above, a feature of the present embodiment is that the "normal dot adjustment value acquisition mode" and the "high accuracy dot adjustment value acquisition mode" can be executed. Consequently, it is now possible to provide printing position adjustment that is capable of accommodating diversified needs of users ranging from those who desire high accuracy adjustment of printing positions to those who wish to adjust printing positions in an easy manner. In addition, providing the "high accuracy dot adjustment value acquisition mode" wherein printing position adjustment is performed using coated paper enables printing position adjustment at high accuracy and, in turn, enables high quality image printing.

(Others)

The present invention is particularly advantageous for a print head and a printing apparatus employing an ink jet printing method. In particular, the present invention is advantageously applied to a print head and a printing apparatus employing a method wherein means (for example, a discharge heater, laser light, or the like) for generating thermal energy as energy to be used to cause ink discharge is provided and state variations in ink are caused by the thermal energy. This is because such a method enables printing at high density and high accuracy.

As for representative configurations and working principles of this method, for example, the basic principles disclosed in U.S. Pat. Nos. 4,723,129 and 4,740,796 may preferably be used.

This method is applicable to both so-called on-demand printing apparatuses and continuous printing apparatuses. In particular, an on-demand printing apparatus is advantageous in that thermal energy can be generated by applying a drive signal to a discharge heater in correspondence to printing information to cause film boiling on a thermal action surface of a print head, thereby enabling the formation of bubbles in ink which correspond one-to-one to drive signals. The formation and contraction of the bubbles cause ink discharge from orifices of the print head. Arranging the drive signal to take a pulse form is preferable since the formation and contraction of bubbles will be performed instantly and suitably, thereby achieving ink discharge having particularly excellent responsiveness. Drive signals such as those described in U.S. Pat. Nos. 4,463,359 and 4,345,262 are suitable as the pulse-shaped drive signal. Further improved printing can be performed by adopting conditions described in U.S. Pat. No. 4,313,124 which relates to temperature rise rates of the aforementioned thermal action surface.

As for the configuration of a print head, in addition to the configuration that combines the orifices, the discharge heaters and the ink flow channels (linear or right-angled ink flow paths) described in the respective specifications described above, configurations disclosed in U.S. Pat. Nos. 4,558,333 and 4,459,600 wherein thermal action units bend are also included in the present invention. Furthermore, configurations based on Japanese Patent Laid-open No. 59-123670 that discloses a configuration wherein a common slit is used as a discharge unit of a discharge heater and Japanese Patent Laid-open No. 59-138461 that discloses a configuration wherein an aperture that absorbs pressure waves caused by thermal energy is associated with a discharge unit are also included in the present invention. This is because the advantageous effects of the present invention may be achieved regardless of the configuration of print heads.

The present invention can also be advantageously applied to serial-type printing apparatuses such as those described above. The present invention is applicable to printing apparatuses using any type of print head, including: a print head fixed to a printing apparatus main body; a replaceable print head; and a cartridge type print head integrated with an ink tank. The types and the number of print heads to be mounted are not limited.

Furthermore, while the above embodiments have been described as using liquid ink, ink that is solid at normal room temperature or a higher temperature and which softens or liquefies at a certain high temperature may be used instead. With a general ink jet printing apparatus, in order to realize a viscosity preferable for stable ink discharge, temperature adjustment is performed so that ink temperature falls within a predetermined range of 30 to 70 degrees Celsius. Consequently, ink that is solid at normal room temperature or a higher temperature can be liquefied by adjusting the temperature thereof upon printing. By using such an ink, evaporation of volatile components in the ink can be prevented. The ink may be arranged as described in Japanese Patent Laid-open Nos. 54-56847 and 60-71260, wherein such an ink is retained in liquid or solid form in recesses or through-holes in a porous sheet and is discharged when brought into a position opposing a discharge heater.

Moreover, the ink jet method according to the present invention may be implemented in forms including an apparatus used as an image output terminal for information processing devices such as computers, a copying machine combined with a reader, and a facsimile machine having a transmission/reception function.

The present invention is also applicable to a program that executes a printing position adjusting method and a storage medium that stores the program which are capable of achieving the advantageous effects of the present invention.

The present invention can be utilized in a printing system that performs dot matrix printing while adjusting dot printing positions through dot adjustment value acquisition processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-024731, filed Feb. 2, 2007, which is hereby incorporated by reference herein in its entirety.

What is claimed is:

1. A method of adjusting the relative position of a first dot and a second dot being printed on a print medium comprising the steps of:

selecting either a lower accuracy position adjustment mode for use with a first print medium or a higher accuracy position adjustment mode for use with a further print medium, a print medium type of which is different from that of the first print medium, acquiring an adjustment value using the selected position adjustment mode, and adjusting the relative position of the second dot relative to the first dot using the acquired adjustment value.

2. The according to claim 1, wherein the first print medium is plain paper, and the further print medium is coated paper.

3. The method according to claim 1, wherein the dots are printed using a print head which performs printing during reciprocal scans, the first dot being a dot that is printed during a forward scan of the print head, and the second dot being a dot that is printed during a backward scan of the print head.

4. The method according to claim 1, wherein the dots are printed using a print head including a first orifice array and a second orifice array, the first dot being a dot that is printed by said first orifice array, and the second dot being a dot that is printed by said second orifice array.

5. The method according to claim 1, further comprising the steps of:

setting whether the higher accuracy position adjustment mode will be executed in the event that the lower accuracy position adjustment mode is selected in said selecting step, and re-executing the higher accuracy position adjustment mode in the event that the execution of the higher accuracy position adjustment mode is set in said setting step.

6. The method according to claim 1, wherein if an adjustment value using the lower accuracy dot position adjustment mode has been acquired, a further adjustment value is acquired using a first adjustment value in the higher accuracy position adjustment mode.

7. The method according to claim 1, wherein a first adjustment value and a further adjustment value are adjustment values for adjusting the printing position of the second dot using the first dot as a reference.

8. A host apparatus connectable to a printing apparatus capable of acquiring an adjustment value for adjusting a relative positional relationship on a print medium of a first dot and a second dot among a plurality of dots printed on the print medium, said host apparatus comprising:

a selection unit that causes selection of either one of a first dot adjustment value acquisition mode in which the printing apparatus acquires, using a first print medium, a first adjustment value for adjusting the positional relationship and a second dot adjustment value acquisition mode in which the printing apparatus acquires, using a second print medium, a print medium type of which is different from that of the first print medium, a second adjustment value that enables adjustment of the positional relationship at a higher adjustment accuracy than the first adjustment value; and a transmission unit that transmits information on the selected dot adjustment value acquisition mode to said printing apparatus.

9. A printing system capable of adjusting the relative position of a first dot and a second dot being printed on a print medium comprising:

a selecting unit configured to select, or to allow a user to select, either a lower accuracy position adjustment mode for use with a first print medium or a higher accuracy position adjustment mode for use with a further print medium, a print medium type of which is different from that of the first print medium, an acquisition unit configured to acquire an adjustment value using the selected position adjustment mode, a printing unit capable of printing dots, and an adjustment unit adapted to adjust the relative position of a second dot relative to a first dot using the acquired adjustment value.

10. A computer readable storage medium storing a program which when loaded into a computer and executed performs the following method of adjusting the relative position of a first dot and a second dot being printed on a print medium:

selecting either a lower accuracy position adjustment mode for use with a first print medium or a higher accuracy position adjustment mode for use with a further print medium, a print medium type of which is different from that of the first print medium, acquiring an adjustment value using the selected position adjustment mode, and adjusting the relative position of the second dot relative to the first dot using the acquired adjustment value.

* * * * *